US012157594B2

(12) United States Patent
Zaniboni

(10) Patent No.: US 12,157,594 B2
(45) Date of Patent: Dec. 3, 2024

(54) MACHINE AND METHOD FOR THE AUTOMATIC TREATMENT OF COMPONENTS OF INHALERS; IN PARTICULAR CARTOMIZERS FOR ELECTRONIC CIGARETTES

(71) Applicant: I.M.A. Industria Macchine Automatiche S.p.A., Ozzano dell'Emilia (IT)

(72) Inventor: Carlo Zaniboni, Ozzano dell'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 658 days.

(21) Appl. No.: 17/058,985

(22) PCT Filed: May 21, 2019

(86) PCT No.: PCT/EP2019/063142
§ 371 (c)(1),
(2) Date: Nov. 25, 2020

(87) PCT Pub. No.: WO2019/228872
PCT Pub. Date: Dec. 5, 2019

(65) Prior Publication Data

US 2021/0221547 A1 Jul. 22, 2021

(30) Foreign Application Priority Data

May 28, 2018 (IT) ..... 102018000005756

(51) Int. Cl.
*B65B 65/00* (2006.01)
*A24F 40/10* (2020.01)
(Continued)

(52) U.S. Cl.
CPC ..... *B65B 65/003* (2013.01); *A24F 40/10* (2020.01); *A24F 40/42* (2020.01); *A24F 40/70* (2020.01);
(Continued)

(58) Field of Classification Search
None
See application file for complete search history.

(56) References Cited

U.S. PATENT DOCUMENTS 3,243,936 A 4/1966 Anderson
3,248,841 A * 5/1966 Heffelfinger ..... B65B 51/144 392/382
(Continued)

FOREIGN PATENT DOCUMENTS

DE 2827885 A1 1/1980
DE 4333186 A1 4/1994
(Continued)

OTHER PUBLICATIONS

Int'l Search Report and Written Opinion issued Sep. 10, 2019 in Int'l Application No. PCT/EP2019/063142.

*Primary Examiner* — Tanzim Imam
(74) *Attorney, Agent, or Firm* — Panitch Schwarze Belisario & Nadel LLP

(57) ABSTRACT

A machine and method for the automatic treatment of components of inhalers, in particular cartomizers for electronic cigarettes, includes a transporting member configured to selectively transport the components from a first operational module to a final operational module and a plurality of intermediate operational modules. The transporting member includes a first chain having a plurality of links equal to each other. The width of each operational module is a whole multiple of the interaxis between the links of the chain.

10 Claims, 23 Drawing Sheets

(51) Int. Cl.

| | |
|---|---|
| ***A24F 40/42*** | (2020.01) |
| ***A24F 40/70*** | (2020.01) |
| ***B65B 3/04*** | (2006.01) |
| ***B65B 43/46*** | (2006.01) |
| ***B65B 43/52*** | (2006.01) |
| ***B65B 59/00*** | (2006.01) |

(52) U.S. Cl.

CPC ..... *B65B 3/04* (2013.01); *B65B 43/46* (2013.01); *B65B 43/52* (2013.01); *B65B 59/00* (2013.01); *B65B 2210/02* (2013.01)

(56) References Cited

U.S. PATENT DOCUMENTS 4,860,519 A * 8/1989 Lemaire ..... B65B 59/04 53/167
5,144,790 A 9/1992 Tisma
5,584,160 A * 12/1996 Andrea ..... B65G 19/02 53/251
5,711,137 A 1/1998 Moncrief et al.
2005/0087462 A1* 4/2005 Zaniboni ..... B65B 7/26 206/312
2013/0056332 A1* 3/2013 Cavina ..... B65G 19/02 198/728
2017/0369196 A1 12/2017 Robbins

FOREIGN PATENT DOCUMENTS

EP 2538227 A1 12/2012
EP 3269669 A1 1/2018
KR 20110088189 A 8/2011
WO 2015140768 A2 9/2015
WO 2018078565 A1 5/2018

* cited by examiner

MACHINE AND METHOD FOR THE AUTOMATIC TREATMENT OF COMPONENTS OF INHALERS; IN PARTICULAR CARTOMIZERS FOR ELECTRONIC CIGARETTES

CROSS-REFERENCE TO RELATED APPLICATIONS

This application is a Section 371 of International Application No. PCT/EP2019/063142, filed May 21, 2019, which was published in the English language on Dec. 5, 2019, under International Publication No. WO 2019/228872 A1, which claims priority under 35 U.S.C. § 119 (b) to Italian Application No. 102018000005756, filed May 28, 2018, the disclosures of each of which are incorporated herein by reference in their entireties.

FIELD OF APPLICATION

The field of application of the present invention is that of machines and methods for the automatic treatment of components of inhalers, i.e. to carry out on them one or more operational steps and/or one or more inspection steps. In particular, but not only, said components can be cartomizers for electronic cigarettes, in other words objects each composed of a cartridge containing an atomizer that is able to transform the liquid it contains into vapour by means of a heating element, for example an electrical resistance.

STATE OF THE ART

In the field of inhalers in general and electronic cigarettes in particular, one component that receives particular attention from the manufacturers of such products is the so-called cartomizer, that is a cartridge of a substantially tubular form that contains an atomizer that is able to selectively transform into vapour a particular liquid that is also contained by that same cartridge.

In the case of electronic cigarettes the size of a single cartridge is substantially equivalent to the size of a regular tobacco cigarette, for example having a length of approximately 60 mm and an external diameter of approximately 9 mm and an outward surface with a tactile and aesthetic finish that will be appreciated by the user.

Furthermore, each cartridge has openings at either end, through which it is possible to arrive at the elements contained by the cartridge, for example a small reservoir for the liquid that is to be vaporized and the electric and electronic parts of the atomizer.

One of the technical problems that designers of machines for the automatic treatment of said components have to face and solve is that of creating highly complex machines but that are also very versatile and can be easily put together, adding or removing one or more work or inspection stations.

Another technical problem is that of the high level of productivity that should be obtained with a machine for the automatic treatment of said components, so that the production cost of each single component is sufficiently low to make the component competitive in the market. By way of example, a target value for said productivity could be 1,000 components to be filled with liquid per minute, which means that the apparatus must be able to automatically treat a component approximately every 6 hundredths of a second.

One goal of the present invention is therefore to provide a machine and a related method for the automatic treatment of components of inhalers, in particular, but not only, cartomizers for electronic cigarettes, which, overcoming the drawbacks of the prior art, is fast and reliable and which allows all the work and/or inspection steps to be carried out without damaging the treated component, including their external surface.

Another goal of the present invention is to provide a machine and a related method for the automatic treatment of components of inhalers, in particular, but not only, cartomizers for electronic cigarettes, that also has a high level of productivity, in the order of treating 1,000 inhalers per minute.

Another goal of the present invention is to provide a machine and a related method for the automatic treatment of components of inhalers, in particular, but not only, cartomizers for electronic cigarettes, that is modular, i.e. that allows an easy addition or removal of one or more work and/or inspection stations.

To overcome the drawbacks of the prior art and to obtain these and other goals and advantages, the applicant has studied, experimented and created the machine and set up the method of injecting in accordance with the present invention.

SUMMARY OF THE INVENTION

The present invention is described and characterized in the independent claims, whereas the dependent claims present other characteristics of the present invention, or variants on the idea of the main solution.

In accordance with said goals, a machine for the automatic treatment of components of inhalers, in particular cartomizers for electronic cigarettes, comprises a first transporting member configured to selectively transport the components from a first operational module, provided with loading means to load the components onto the first transporting member, to a final operational module, provided with transfer means to transfer the components outside of the first transporting member, and one or more intermediate operational modules interposed between the first operational module and the final operational module and configured to perform work and/or inspection steps on the components.

In accordance with one characteristic of the present invention, the first transporting member comprises a first chain having a plurality of links equal to each other, each of which is connected in an articulated manner to the two adjacent links so as to define a first interaxis between two adjacent links; furthermore, each intermediate operational module has a length which is a first whole multiple of said first interaxis and which is equipped with all the mechanical and electric/electronic apparatuses or devices needed to perform the required operations.

In accordance with another characteristic of the present invention, the first chain is stretched between a first toothed wheel arranged in said first operational module and a second toothed wheel arranged in said final operational module. Furthermore, the first chain, in the zone comprised between the first wheel and the second wheel, comprises a plurality of segments each formed by a determinate number of links and guided by guide means present in said intermediate operational modules.

In accordance with another characteristic of the present invention, each intermediate operational module is autonomous with respect to the other operational modules and comprises, at rest, one of said segments of the first chain, both in its upper portion, from the first wheel to the second wheel, and in its lower portion, from the second wheel to the first wheel, in which each segment has a length that is equal to the length of the corresponding intermediate operational module.

In accordance with another characteristic of the present invention, control means are present to make said first transporting member perform incremental advances of a determinate pitch at a time, and this pitch is a second whole multiple of said first interaxis.

In accordance with another characteristic of the present invention, a first number of seats is associated with each link of the first chain, aligned on a first longitudinal axis and configured to accommodate one component; furthermore, said first interaxis is another whole multiple of the interaxis between two adjacent seats.

In accordance with another characteristic of the present invention, in which each component comprises a central body, preferably of a tubular shape, having a lower end part normally protected by removable lower protection means and an upper end part normally protected by a removable upper protection means, a first of said intermediate operational modules comprises both removal means configured to remove the lower protection means and the upper protection means from the corresponding central bodies to place them on the first transporting member, so that the lower protection means and the upper protection means remain removed from, but associated with the corresponding central bodies, and storage means configured to remove the lower protection means and the upper protection means from the corresponding central bodies to place them temporarily on at least one storage member and then to return them selectively to the first transporting member, so that the lower protection means and the upper protection means are associated with different central bodies than the ones from which they were removed.

In accordance with another characteristic of the present invention, a second of said intermediate operational modules comprises filling means configured to selectively insert a liquid into the central bodies of the components. Said filling means comprise a second transporting member substantially parallel to the first transporting member and configured to selectively transport, with incremental advances, another number of said components at a time towards the injection means, in which said other number is a whole multiple of said first number.

In accordance with another characteristic of the present invention, the second of said intermediate operational modules is arranged adjacent to the first of said intermediate operational modules. Furthermore, said storage means are configured in such a manner that, when the components have completed a filling cycle of said liquid and are again transferred onto said first transporting member, the lower protection means and the higher protection means are present on the first transporting member so that they can be reattached to the central bodies of the components.

In accordance with another characteristic of the present invention, the final operational module is provided with transfer means to transfer the components towards a third transporting member provided with a plurality of seats to accommodate the components and said transfer means comprise a transfer device configured to increase the interaxis between the components while they are transferred from the first transporting member to the third transporting member.

In accordance with another characteristic of the present invention, the seats of the first transporting member lie on a vertical plane whereas the plurality of seats of the third transporting member lie on a horizontal plane. Furthermore, said transfer device is configured to perform a rotation of 270° to transfer the components from said vertical plane to said horizontal plane.

In accordance with another characteristic of the present invention, a method for the automatic treatment of components of inhalers, in particular cartomizers for electronic cigarettes, in which each component comprises a central body, preferably of a tubular shape, having a lower end part normally protected by removable lower protection means and an upper end part normally protected by removable upper protection means, comprises a transfer step in which a first transporting member selectively transports the components from a first operational module, provided with loading means to load the components onto the first transporting member, to a final operational module provided with transfer means to transfer the components outside the first transporting member. Furthermore the method comprises both an initial step in which, in an intermediate operational module, storage means remove the lower protection means and upper protection means from the corresponding central bodies to place them temporarily on at least one storage member and then selectively reposition the lower protection means and upper protection means to the first transporting member, so that the lower protection means and upper protection means are associated with different central bodies than the ones from which they were removed, and also a removal step in which, in said intermediate operational, removal means selectively remove the lower protection means and upper protection means from the corresponding central bodies in order to place them on the first transporting member, so that the lower protection means and upper protection means remain removed from the central bodies but still associated with them.

For this purpose, according to another characteristic of the present invention, the first transporting member comprises a plurality of transport means for said components, for example sliders that are movable along the first transporting member and configured to accommodate the central bodies; in which each of the transport means is provided with positioning seats to temporarily position the upper protection means and/or lower protection means. Thanks to this configuration the transporter means are advantageously able to move said components along the first transporter transporting member both when assembled (i.e. with the protection caps inserted onto the central body to protect its extremities) and unassembled. In case of the latter, each of said transport means defines movable equipment that is able to move the central bodies together with the respective upper protection caps and lower protection caps between one or more of said operational modules.

These and other aspects, characteristics, and advantages of the present disclosure will be better understood with reference to the following description, figures and enclosed claims. The figures, which are an integral part of the present description, illustrate a number of embodiments of the present invention and, together with the description, are intended to describe the main principles of this disclosure.

The various aspects and characteristics described in the present description can be applied individually, where possible. These individual aspects, for example aspects and characteristics present in the description or in the enclosed dependent claims, may become the subject of divisional applications.

It should be noted that any aspect or characteristic found to be already known during the patent application procedure, will be exempted from being claimed and instead be the subject of a disclaimer.

DESCRIPTION OF THE DRAWINGS

These and other characteristics of the present invention will become clear in the following description of a preferred embodiment, provided solely as non-limiting example, with reference to the enclosed drawings, wherein.

It is pointed out that in the present description and in the claims the terms above, below, vertical, horizontal, upper, lower, internal, and external and variations thereon only serve to better illustrate the present invention with reference to the figures, and should not be used in any way to limit the scope of the invention itself or the scope of protection as defined by the claims. For example, the term horizontal indicates a plane that can be either parallel to the horizon, or at an inclined angle, also by a substantial degree, to said horizon.

DESCRIPTION OF EMBODIMENTS

In the following reference is made in detail to the various embodiments of the invention, of which one or more are illustrated in the enclosed figures. Each example is provided as an illustration of the invention and should not be interpreted as a limitation thereof. For example, the illustrated or described characteristics of one embodiment can be adapted to or associated with other embodiments to create a further embodiment. This means that the present invention comprises all those modifications and variations.

Before describing the embodiments it is further pointed out that the present description is not limited in its application to details related to the construction or lay-out of the components as described in the following description, using the enclosed figures. The present description can include other embodiments and can be realised or put into practice in various ways. Furthermore it is pointed out that the phrasing and terminology are used here for descriptive purposes, and should not be taken as limitative.

Figure 1:
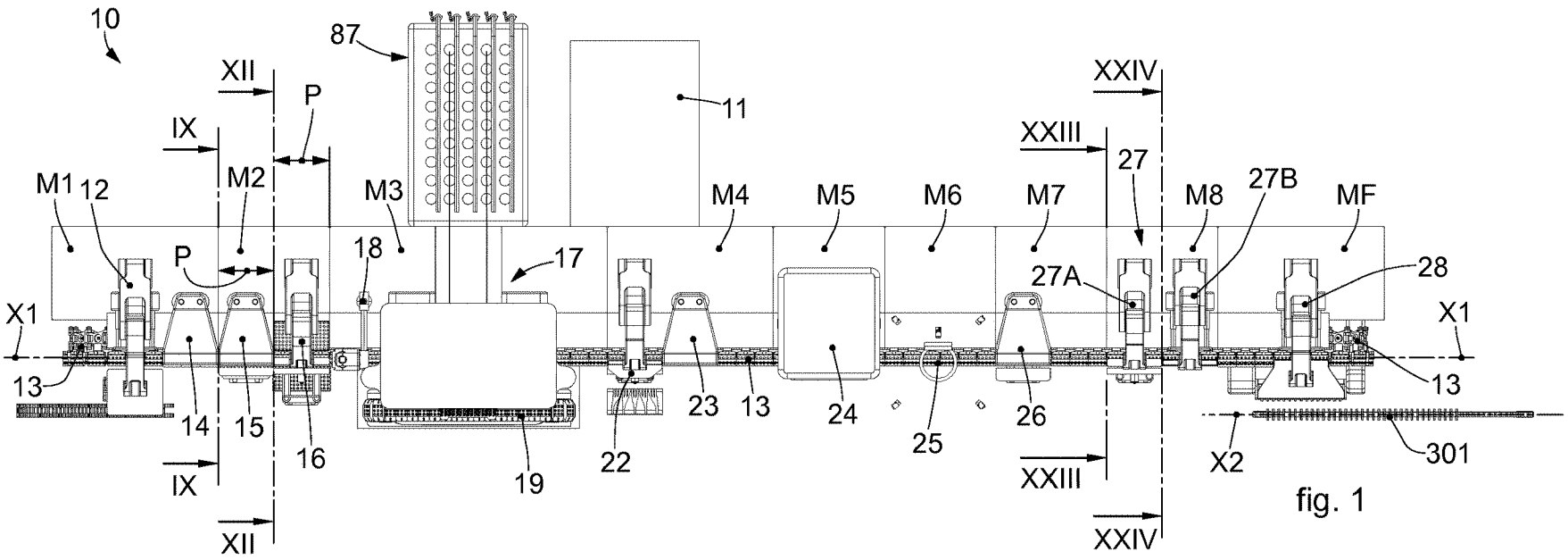
FIG. 1 is a schematic top view of a machine for the automatic treatment of components for inhalers, in particular cartomizers for electronic cigarettes, according to the present invention.
Figure 2:
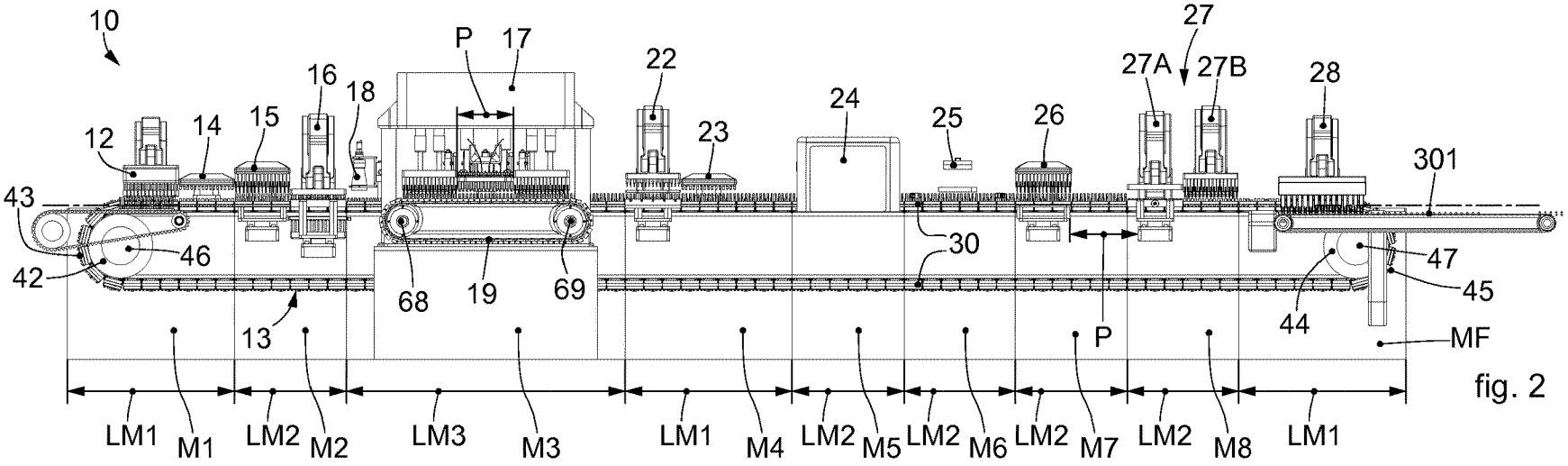
FIG. 2 is a schematic front view of the machine of FIG. 1.

With reference to FIGS. 1 and 2, embodiments are described of a machine 10 for the automatic treatment of components for inhalers, for example cartomizers 201 (FIGS. 3 and 4) for electronic cigarettes.

According to some possible embodiments, said machine 10 comprises a series of operational modules from M1 (FIGS. 1 and 2) to MF, as will be explained in detail below, which are arranged side by side along a first longitudinal axis X1. Each operational module from M1 to MF defines a work and/or inspection station, each configured to perform one or more work and/or one or more inspection steps on said cartomizers 201

It is specified that the number of operational modules of the machine 10 is not fixed, but variable depending on the different work and/or inspection steps that are to be performed on the components for inhalers, so that this number is not a limitation of the scope of protection of the present invention.

Together, the operational modules from M1 to MF define a highly versatile modular system, in which each operational module can selectively be inserted or removed in an easy and rapid manner, as will be described in detail below, without compromising or reducing the productivity of the machine 10 as a whole.

In fact, each operational module from M1 to MF is designed and realized in such a manner that it is equipped with all the apparatuses or devices, mechanical and electric/electronic to perform the required operations. When an operational module is inserted in or removed from the machine 10, the electric connections with the remaining operational modules allow a central control unit 11, schematically rendered in FIG. 1, appositely programmed, to manage all the operational modules present, from M1 to MF, independent of their number.

To better understand the inventive concept of the present invention, before describing in detail the machine 10 and the related method, first an example of the construction of a cartomizer 201 (FIGS. 3 and 4) will be described, it being understood that the present invention is not limited to this example, but that it can be used for the automatic treatment of any component of inhalers that is already known or that will be developed in the future.

By way of example a cartomizer 201 comprises a central tubular body 202, having an internal cavity 203 that is open at both ends and that has an external surface 204, treated in a known manner to be pleasant both to the touch and to the aesthetic appearance. In the example given here, the cartomizer 201 has a length of approximately 60 mm and an external diameter of approximately 9 mm, and the thickness of the cylindrical wall of the central body 12 is approximately 0.2 mm.

Figure 3:
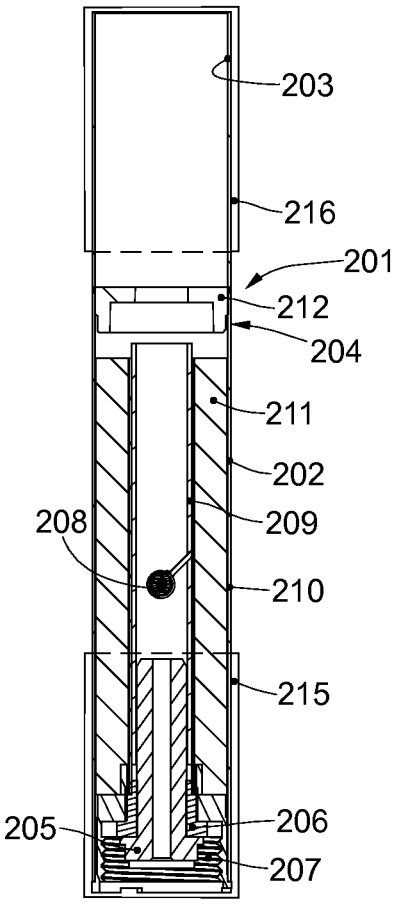
FIG. 3 is a schematic longitudinal cross section view of a cartomizer that can be treated by the machine of FIG. 1.
Figure 4:
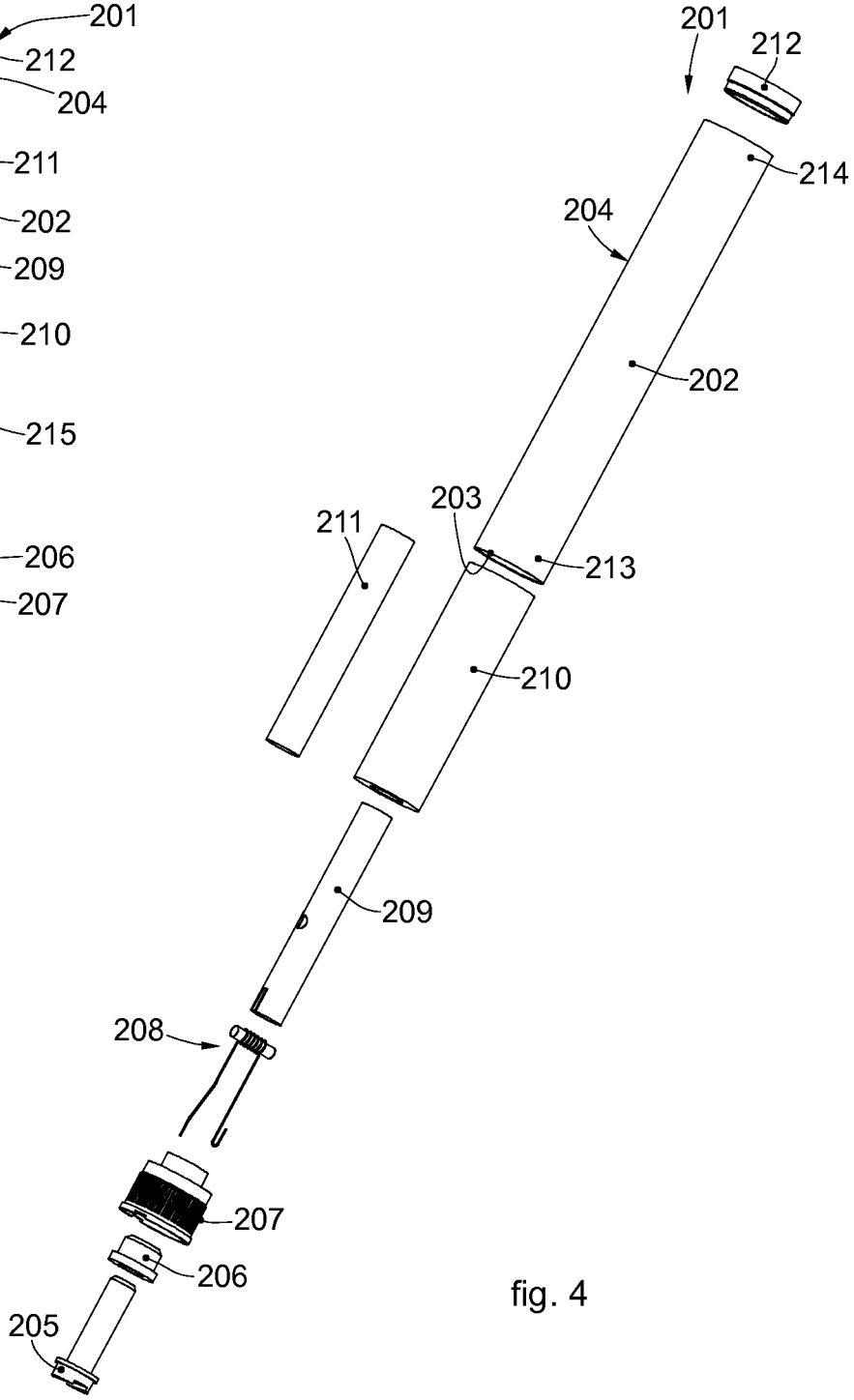
FIG. 4 is an exploded view of the elements that compose the cartomizer of FIG. 3, without the protection caps.

In the lower part of the internal cavity 203 there are—from the bottom to the top in FIG. 3—a metal ring 205 that functions as electrode, a ring of isolating material 206, a cap 207, hollow on the inside and threaded on the outside, and a heating unit 208 connected to the metal ring 205. Furthermore, around the heating unit 208 a tubular element 209 made of glass fibre is arranged. Coaxial with the latter and against the internal wall of the internal cavity 203 a bushing 210 made of a plastic material, for example polyester is arranged. In the annular space between the tubular element 209 and the bushing 210 a cotton felted cloth 211 is arranged, which is configured to be imbued with a specific liquid, for example containing natural or artificial essences, and/or some other substance, destined to become vaporized during the selective activation of the heating unit 208. A blocking ring 212 is intended to be arranged over the felted cloth 211, after the latter has been imbued with liquid.

The upper end part of the internal cavity 203 is empty for a depth of approximately 8-9 mm and is configured to potentially accommodate a tobacco capsule, or some other substance that is suitable to provide a specific flavour to the vapour that the user inhales by drawing air through the upper end of the cartomizer 201.

Each cartomizer 201, during its transport and packaging, or until it is used by the end user, is conveniently protected in such a manner that at least its lower end 213, i.e. the part near the metallic ring 205, and its upper end part 214, i.e. the part near the upper end of the internal cavity 203, are protected from any undesirable contact, impact or damage.

Figures 5A, 5B, 5C:
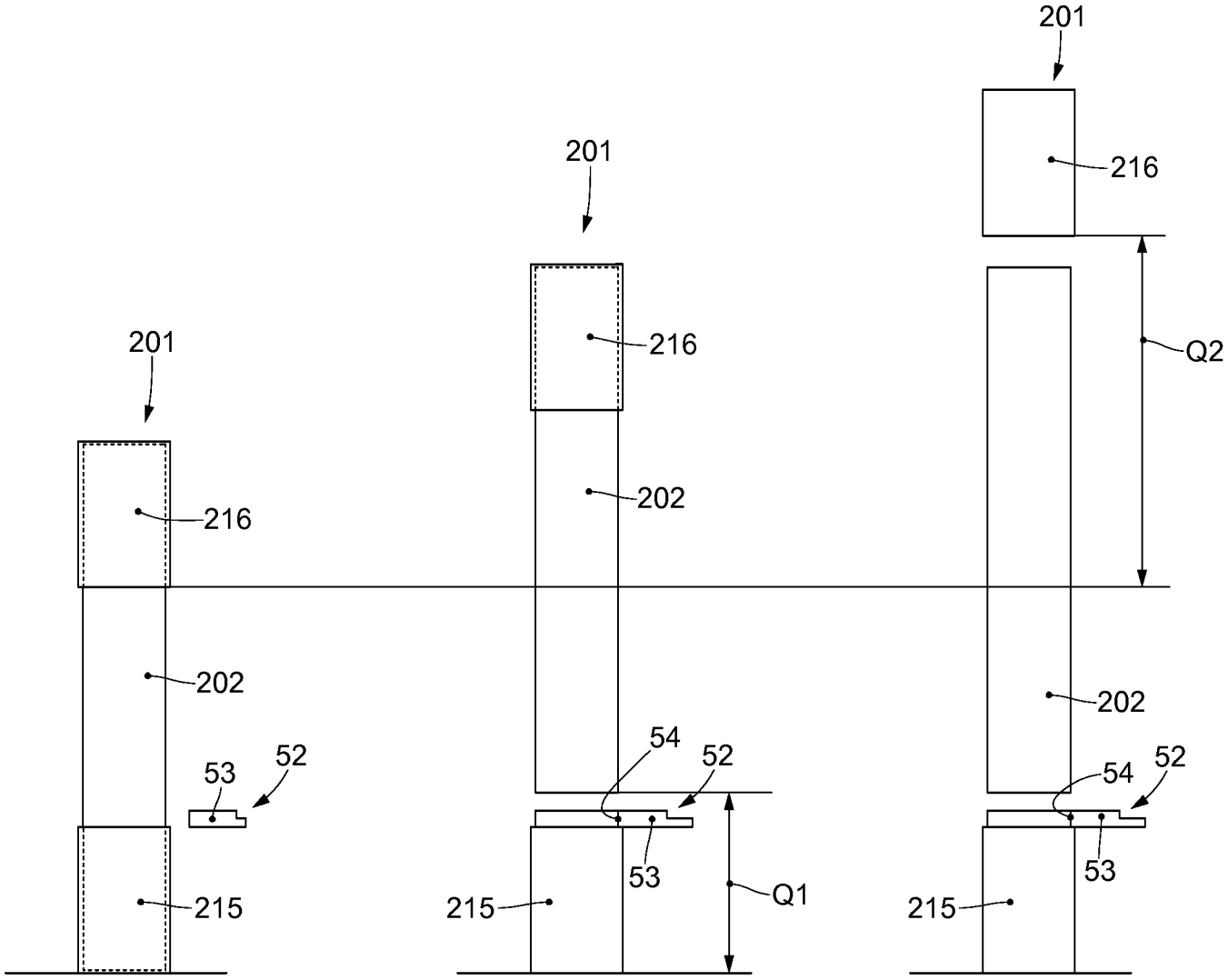
FIGS. 5*a*, 5*b* and 5*c* schematically show the relative position of the central body and the related protection caps of the cartomizer of FIG. 3 in the operational removal step.

To provide this protection, for example, each cartomizer 201 is closed at the bottom by a lower cap 215 (FIGS. 3 and 5*a*) and at the top by an upper cap 216. The caps 215 and 216 are made of a soft and transparent material, for example silicone, and they can be applied, removed, and reapplied again. The height of each cap 215 and 216 is, for example, approximately 15 mm.

Figure 6:
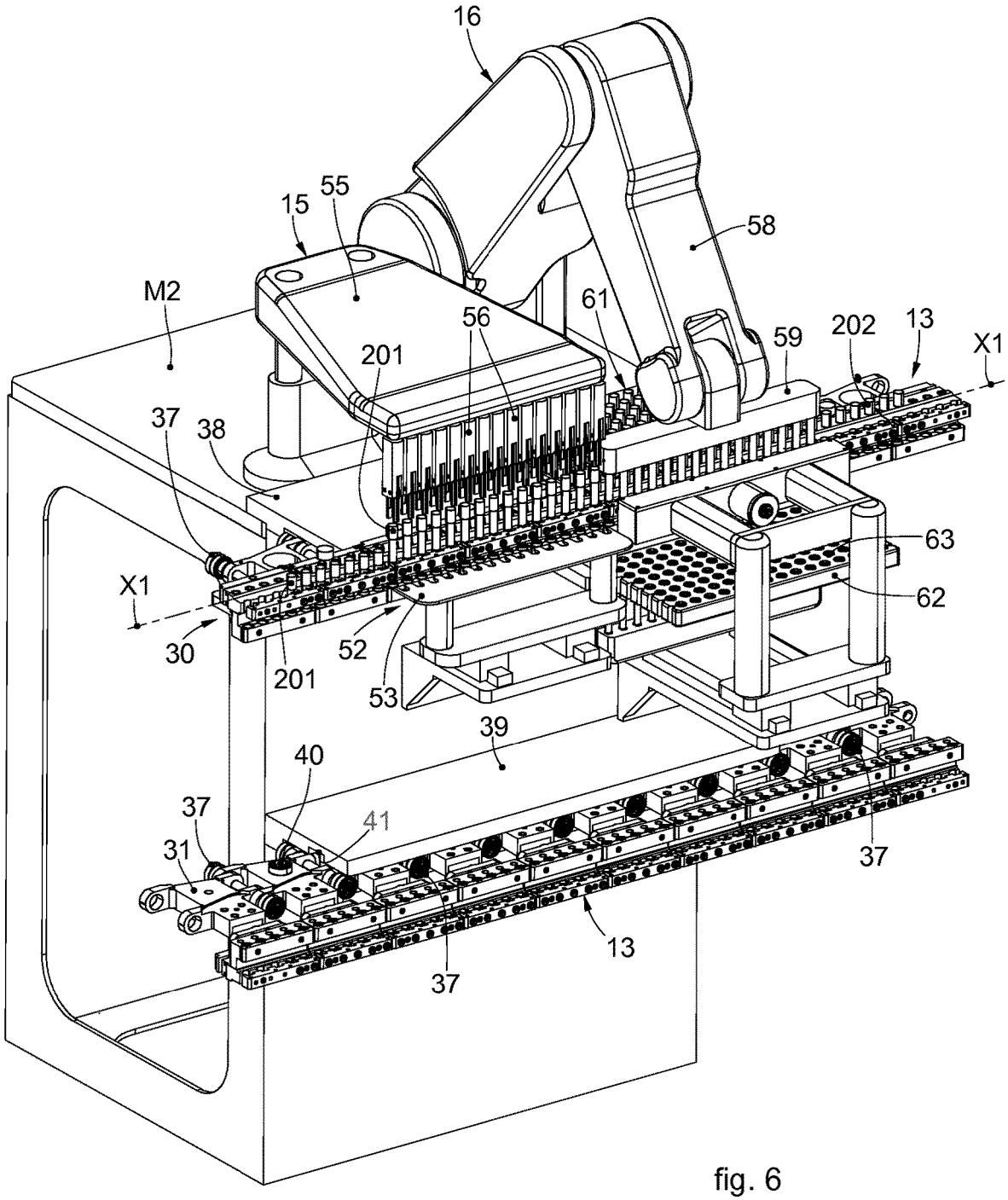
FIG. 6 is a perspective view of an operational module of the machine of FIG. 1.
Figure 7:
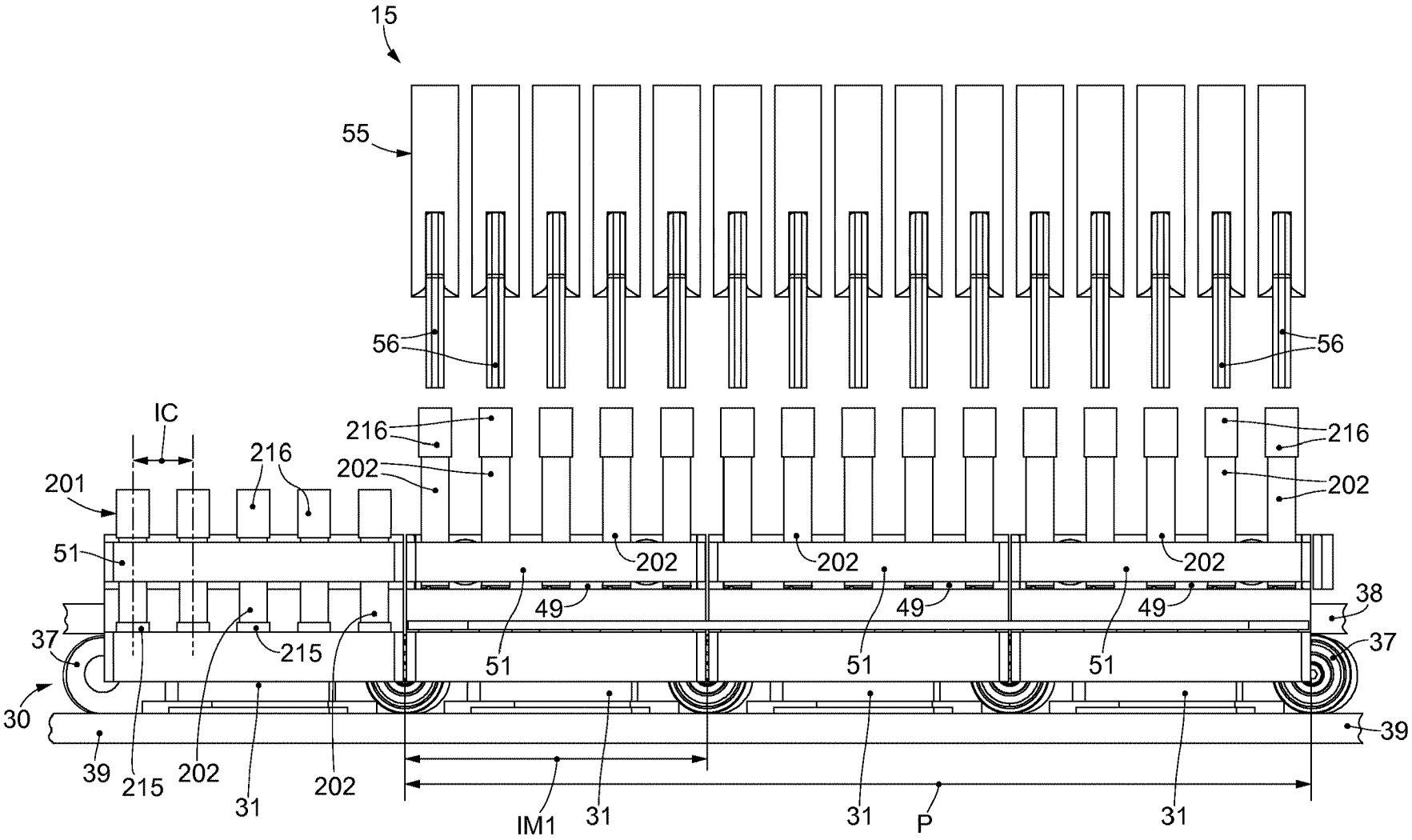
FIG. 7 is a front view of a first enlarged detail of the operational module of FIG. 6.

In the embodiment illustrated here, the machine 10 (FIGS. 1 and 2) comprises a first operational module M1 in which there are loading means 12, configured to load and correctly orient onto a first transporting member 13, arranged parallel and near to the first longitudinal axis X1, a plurality of cartomizers 201 to be treated, including the protection caps 215 and 216 (FIGS. 6 and 7), but each not having the blocking ring 212 (FIG. 3). The loading means 12 are also associated with a first verification means 14 (FIGS. 1 and 2), for example of the optical kind, comprising at least a video camera, configured to verify whether the cartomizers 201 are correctly oriented on the first transporting member 13, for example verifying whether said cartomizers 201 already vertically aligned one behind the other, with the upper empty part of the internal cavity 203 (FIG. 3) directed upwards.

A second operational module M2 (FIGS. 1, 2 and 6) is arranged adjacent to the first operational module M1 and comprises removal means 15, configured to automatically remove the caps 215 and 216 (FIG. 7) from the corresponding central bodies 202 of the cartomizers 201, and storage means 16 (FIGS. 1, 2 and 6), configured to temporarily store the caps 215 and 216 removed by the removal means removal means 15, as will be described in detail below.

Figure 16:
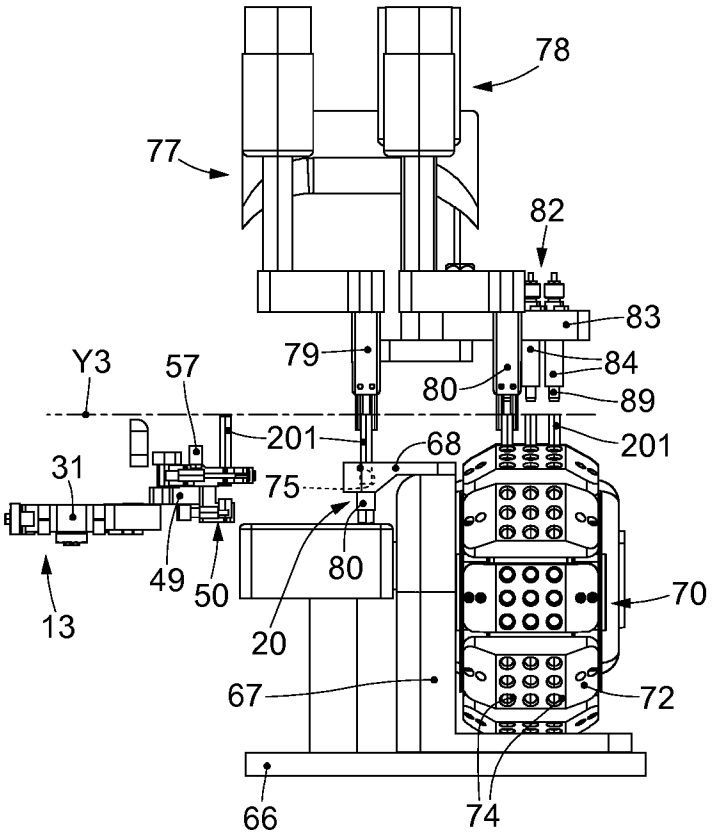
FIG. 16 is a first enlarged detail of FIG. 15.
Figure 14:
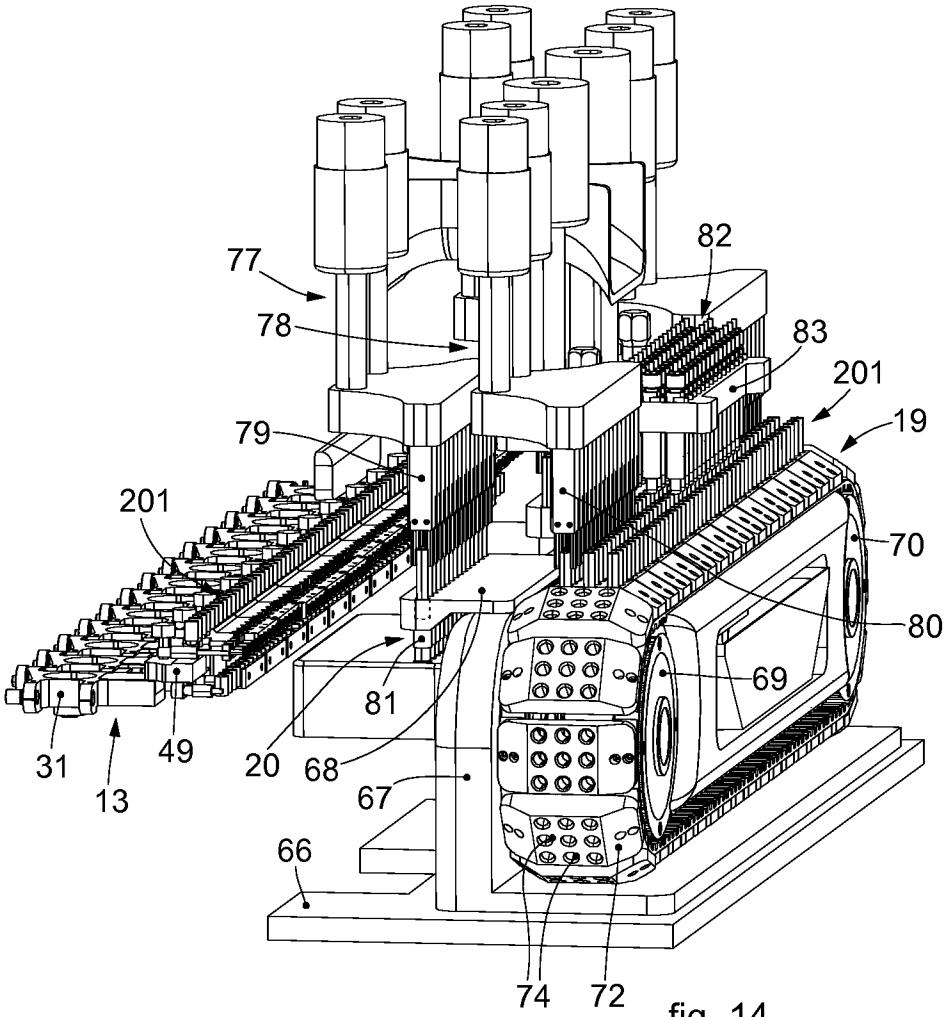
FIG. 14 is a perspective view of the operational module of FIG. 13.
Figure 15:
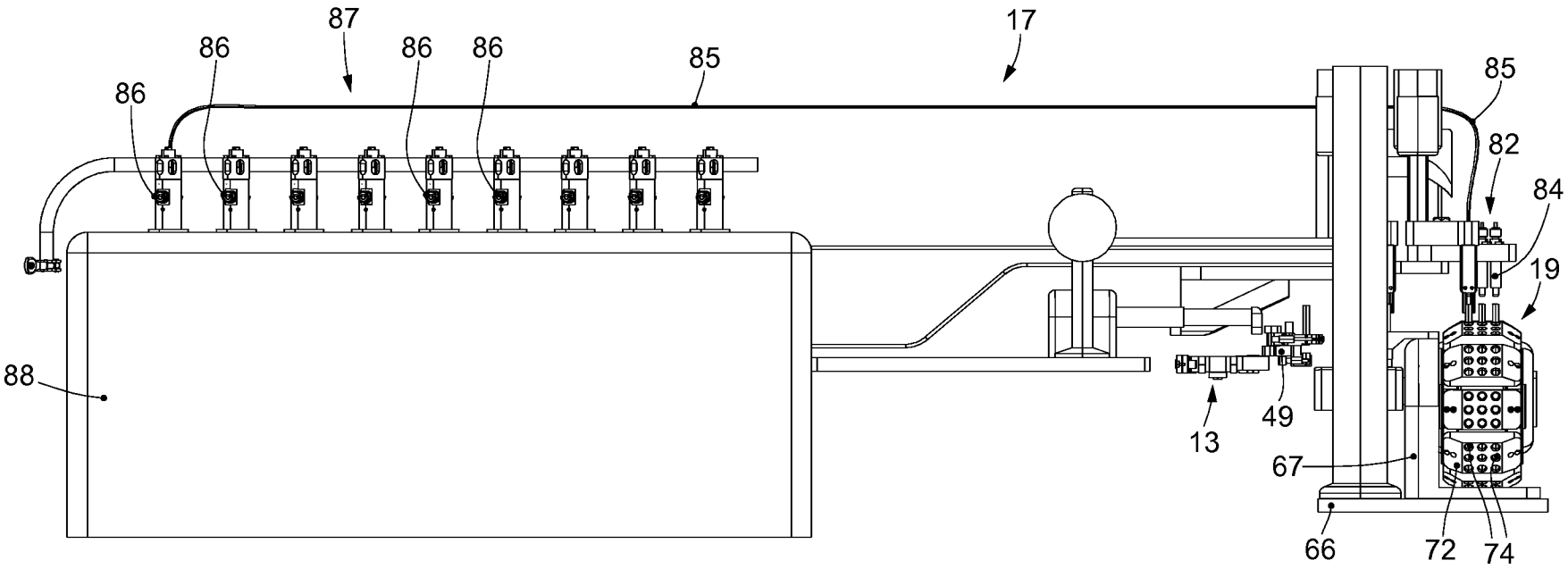
FIG. 15 is a left side view of the operational module of FIG. 13.
Figure 17:
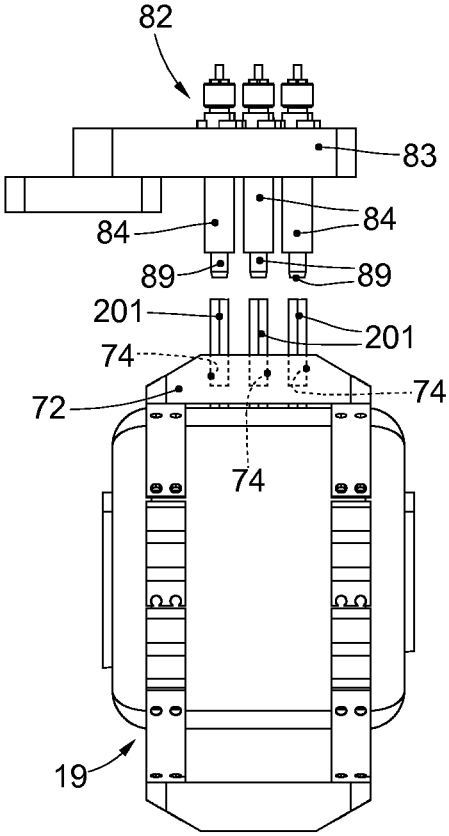
FIG. 17 is a second enlarged detail of FIG. 15.
Figure 18:
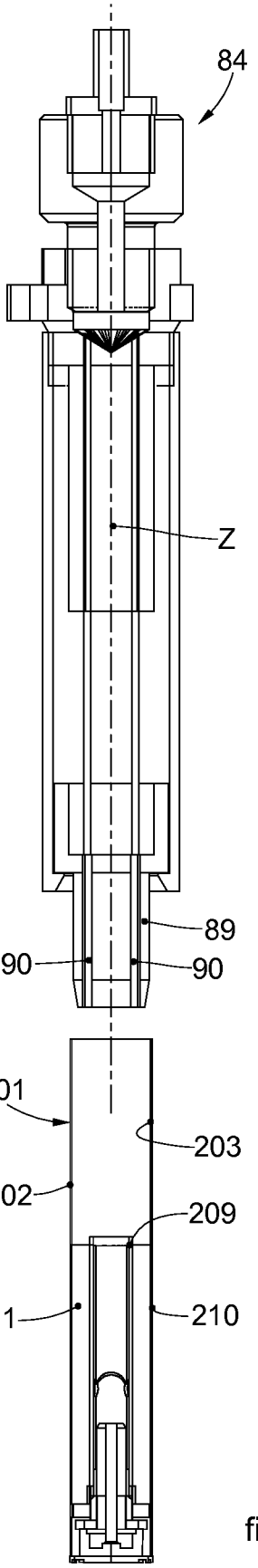
FIG. 18 is a longitudinal cross section of an injector comprised in the operational module of FIG. 13.
Figure 19:
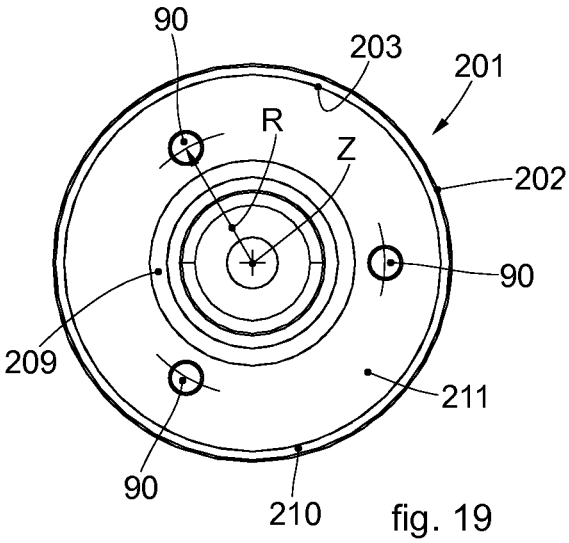
FIG. 19 is a transverse cross section of the injector of FIG. 18 inserted into a cartomizer of FIG. 3.
Figure 20:
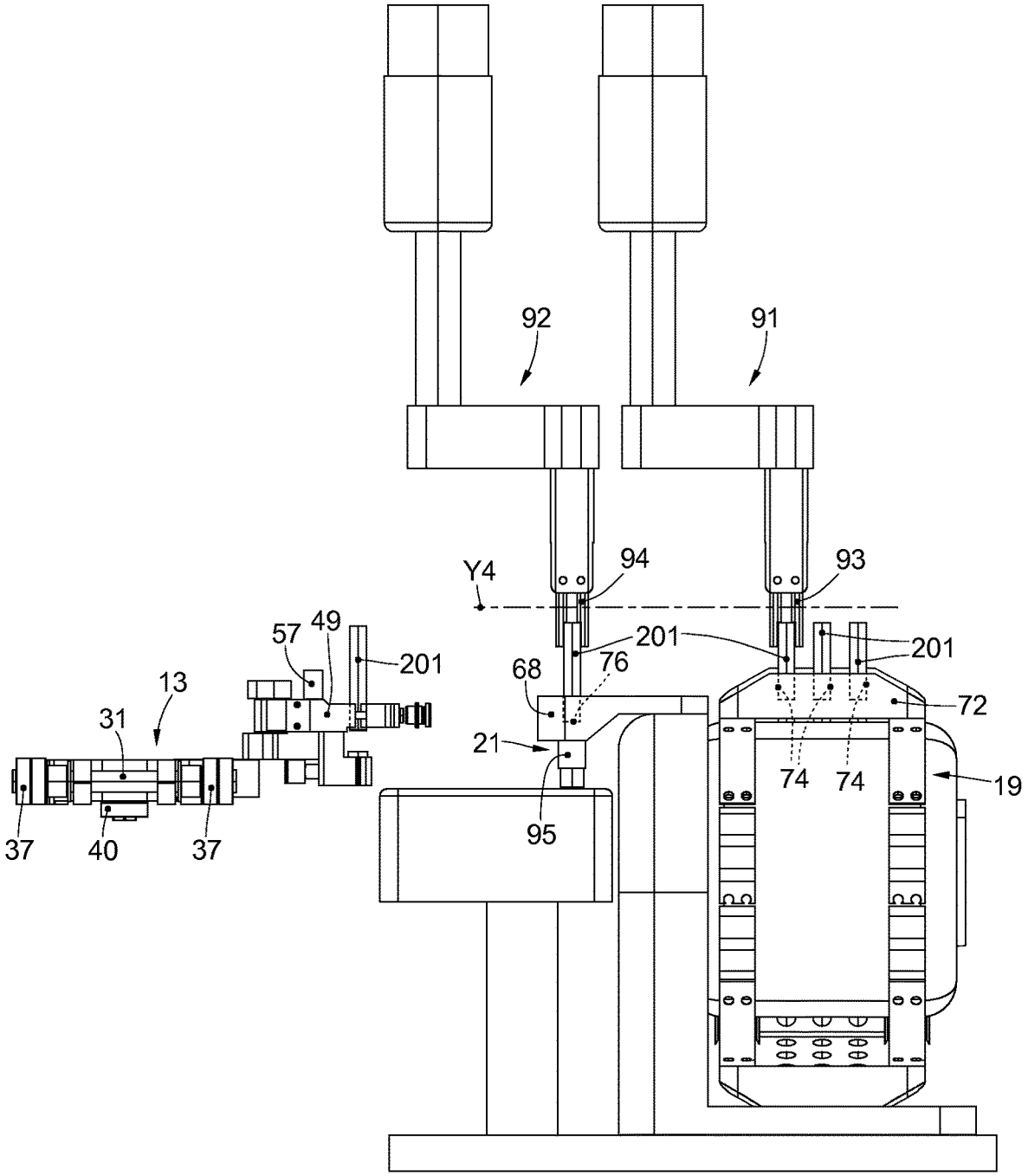
FIG. 20 is a transverse cross section along the line XX-XX of FIG. 13.

Adjacent to the second operational module M2 a third operational module M3 (FIG. 1, 2 *e* 13) is arranged, which comprises both filling means 17, configured to fill from above and automatically each cartomizer 201 with a determined quantity of liquid, and second verification means 18, for example of the optical kind, comprising at least a video camera, arranged immediately before the filling means 17, i.e. on the left of the latter in FIGS. 1 and 2, and configured to verify whether the cartomizers 201 are present and correctly oriented before they reach said filling means 17. The filling means 17 comprise a second transporting member 19, parallel to the first longitudinal axis X1, but disposed on the opposite side with respect to the first transporting member 13 (FIG. 16). The third operational module M3 is also provided with both a first weighing device (FIGS. 14 and 16) configured to weigh each cartomizer 201 before it is filled with liquid in order to determine its tare, and with a second weighing device 21 (FIG. 17) configured to weigh each cartomizer 201 after it has been filled with liquid, to verify the actual quantity of introduced liquid.

The two weighing devices 20 and 21 are connected to the central control unit 11 (FIG. 1), which is also programmed to determine the actual weight of the liquid introduced in each cartomizer 201 and to detect any cartomizers 201 in which the quantity of inserted liquid is outside of a predetermined tolerance, in order to discard them in any of the known manners before they arrive at the final module MF.

A fourth operational module M4 (FIGS. 1 and 2) is arranged adjacent to the third operational module M3 and comprises both introduction means 22 configured to introduce automatically and from above a blocking ring 212 (FIG. 3) into each central body central body 202 of the cartomizers 201, and third verification means 23 (FIGS. 1 and 2), for example of the optical kind, comprising at least a video-camera, arranged immediately downstream from the introduction means 22, i.e. to the right of the latter in FIGS. 1 and 2, and configured to verify whether each blocking ring 212 is present and correctly positioned.

A fifth operational module M5 is arranged adjacent to the fourth operational module M4 and it comprises labelling means, for example by laser beam, configured to label each cartomizer 201 with its own unique identification code, which can subsequently be read for control, acceptance/rejection and/or batch allocation purposes.

A sixth operational module M6 is arranged adjacent to the fifth operational module M5 and it comprises fourth verification means 25, for example of the optical kind, comprising at least a video camera, configured to verify the correct application of said identification code on each cartomizer 201.

A seventh operational module M7 is arranged adjacent to the sixth operational module M6 and it comprises control means 26, configured to check automatically and from below whether the electric/electronic parts of each cartomizer 201 operate correctly, for example the heating unit 208 or the components associated with it.

Figure 21:
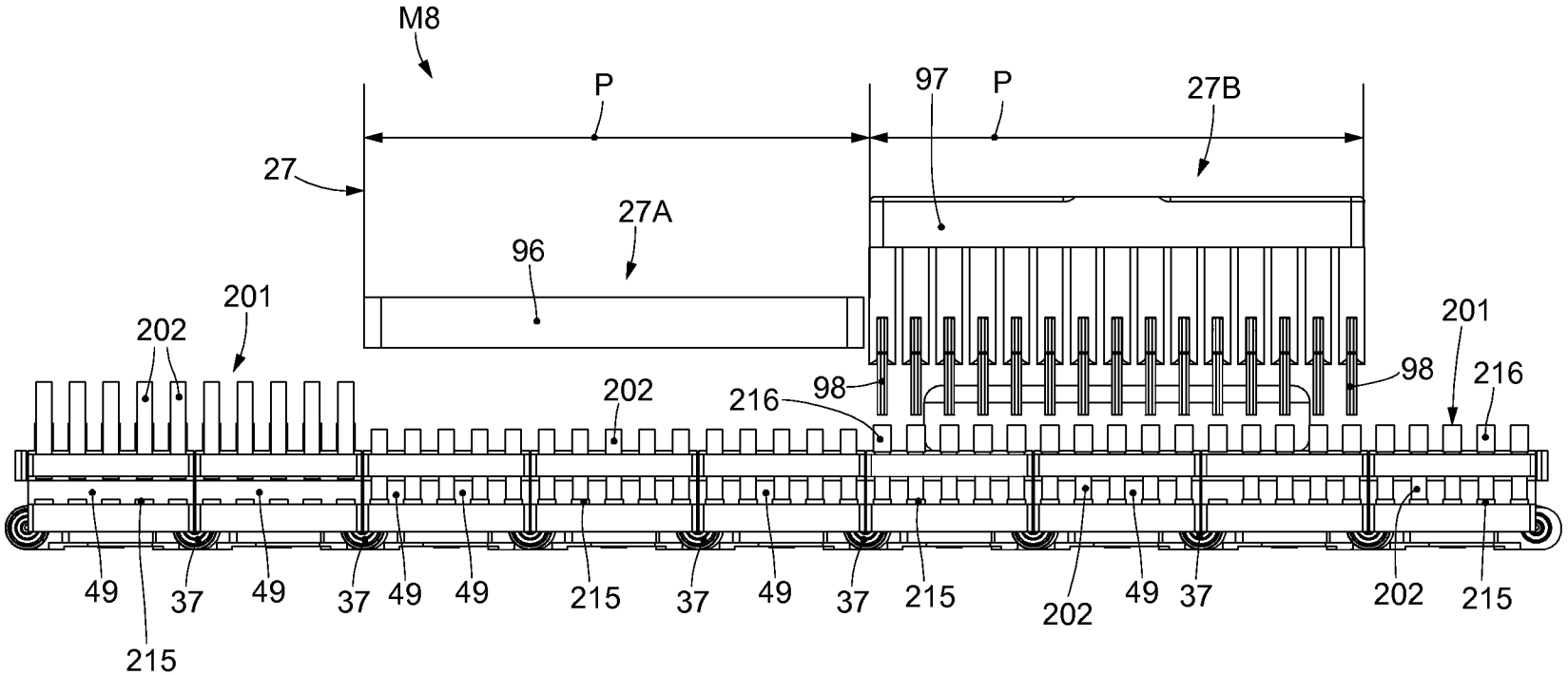
FIG. 21 is a front view of a second enlarged detail of the machine of FIG. 1.

Adjacent to the seventh operational module M7 an eighth operational module M8 is arranged, which comprises repositioning means 27 (FIGS. 1, 2 and 21), configured to automatically reposition the caps 215 and 216 onto the corresponding central bodies central bodies 202 of the cartomizers 201.

Figure 22:
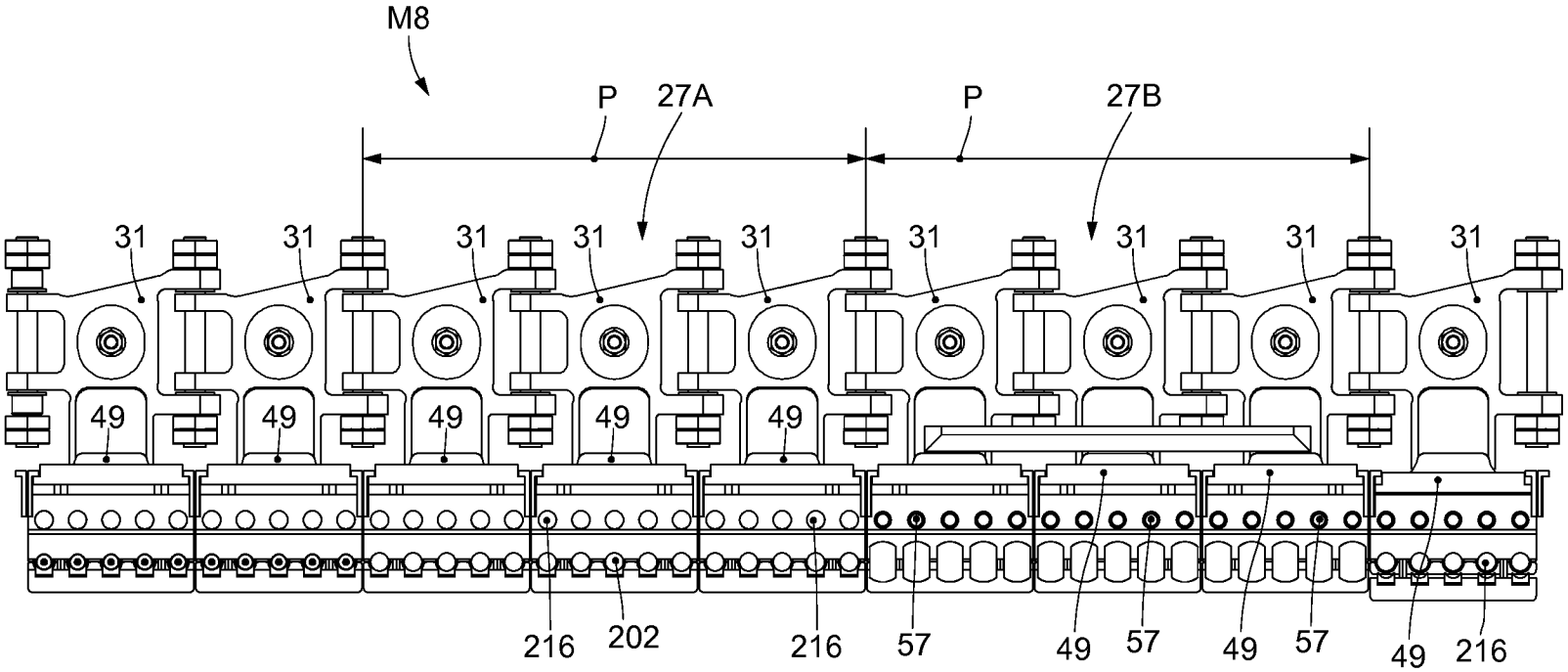
FIG. 22 is a top view of the detail of FIG. 21.
Figure 23:
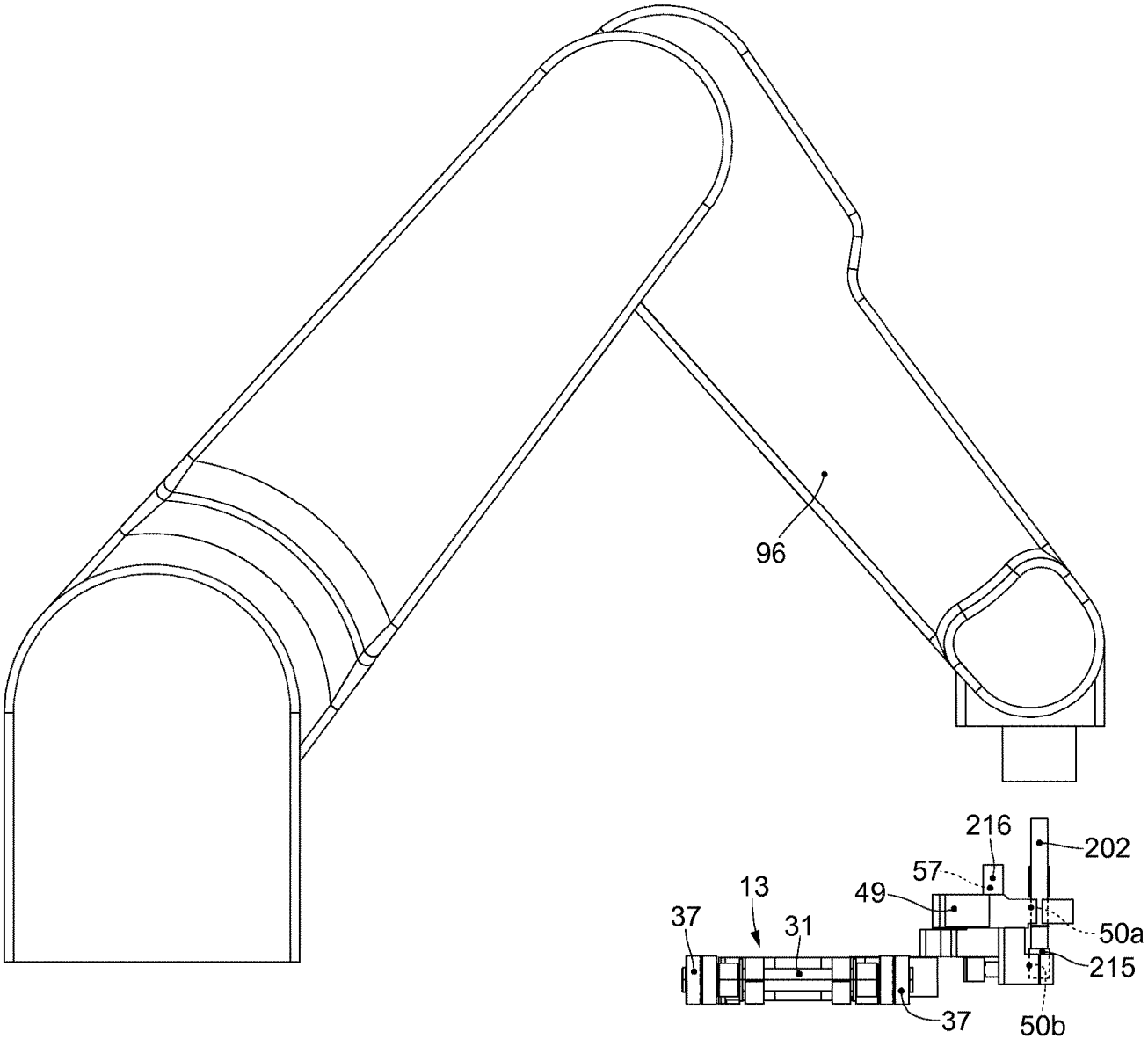
FIG. 23 is a transverse cross section along the line XXIII-XXIII of FIG. 1.
Figure 24:
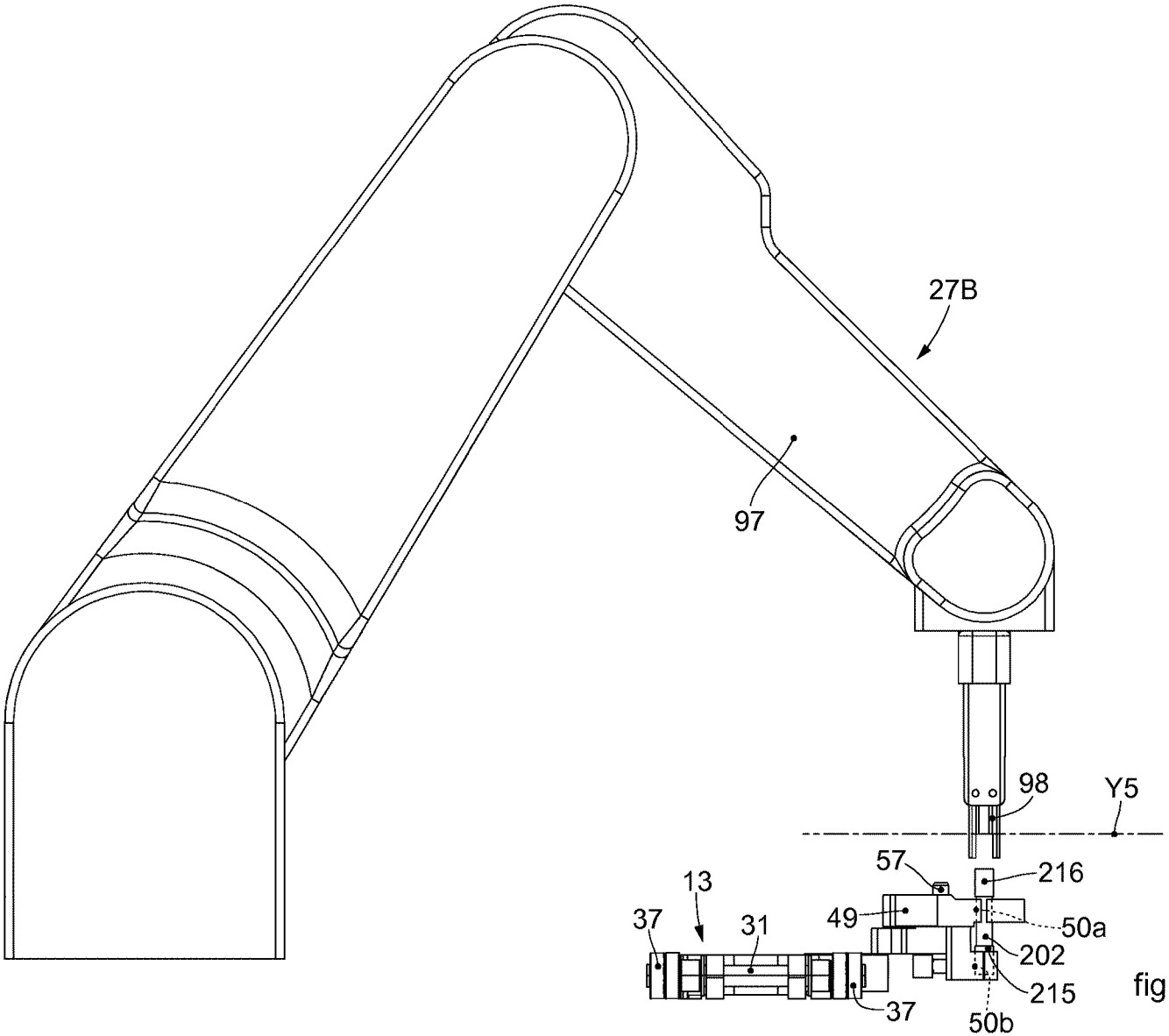
FIG. 24 is a transverse cross section along the line XXIV-XXIV of FIG. 1.

Adjacent to the eighth operational module M8 a final operational module finale MF (FIGS. 1, 2 and 22) is arranged, which comprises transfer means 28, configured to transfer the cartomizers 201 from the machine 10 to the outside, for example towards a third transporting member 301 arranged along the second longitudinal axis X2 parallel to the first longitudinal axis X1 in order to be sent to a packaging station of the known kind and not represented in the drawings.

Figure 8:
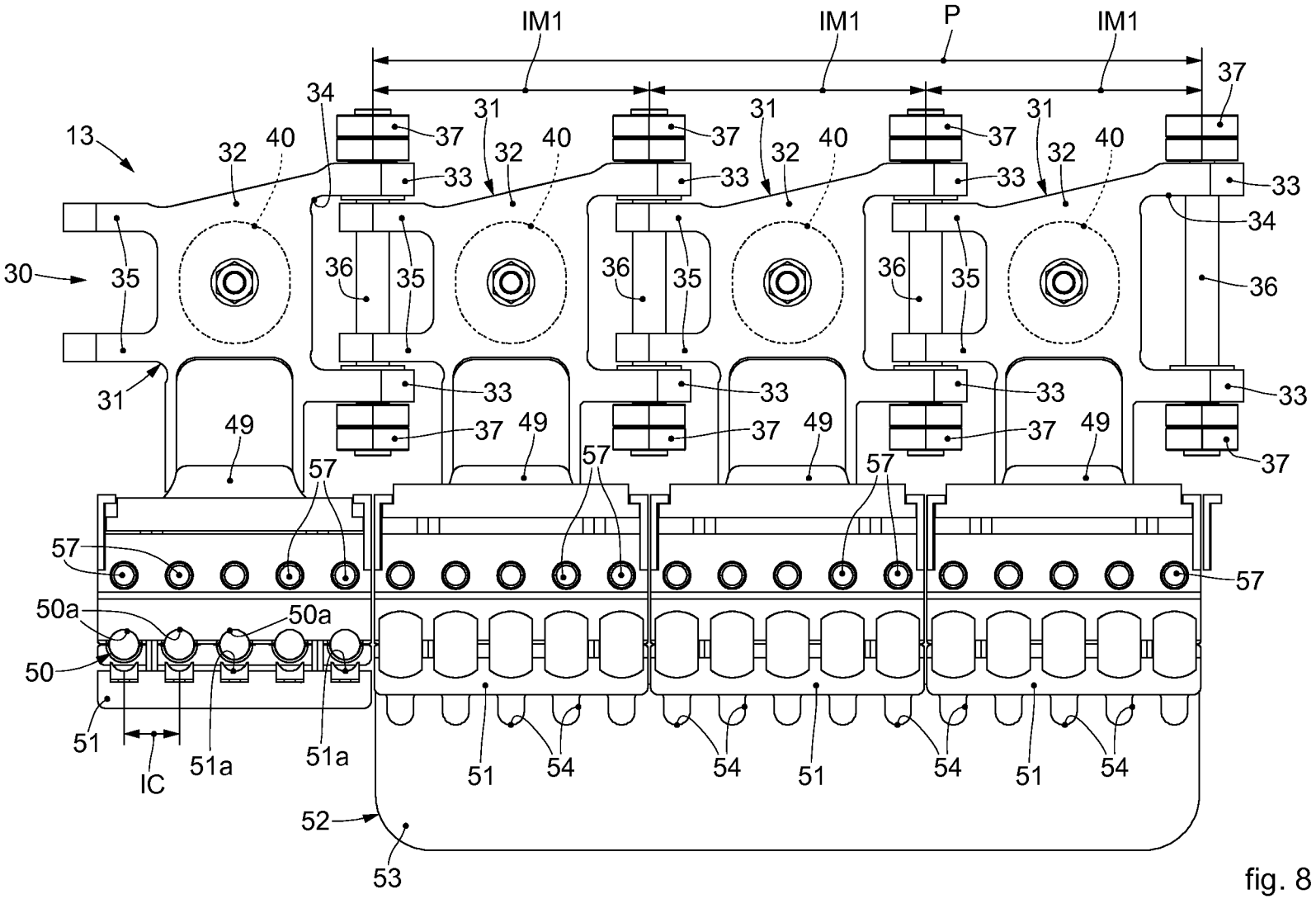
FIG. 8 is a top view of the detail of FIG. 7.
Figure 9:
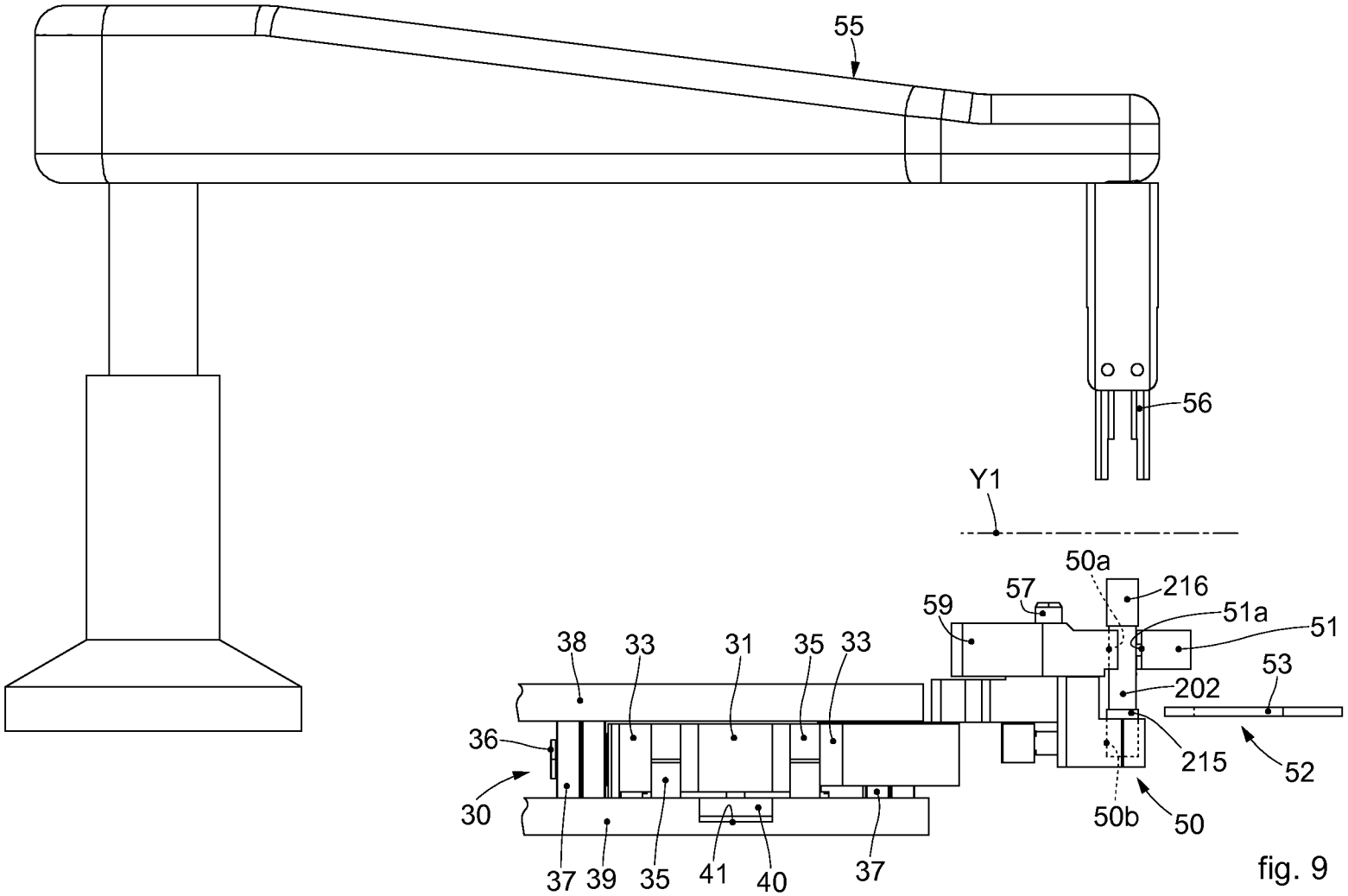
FIG. 9 is a cross section along the line IX-IX of FIG. 1.
Figure 10:
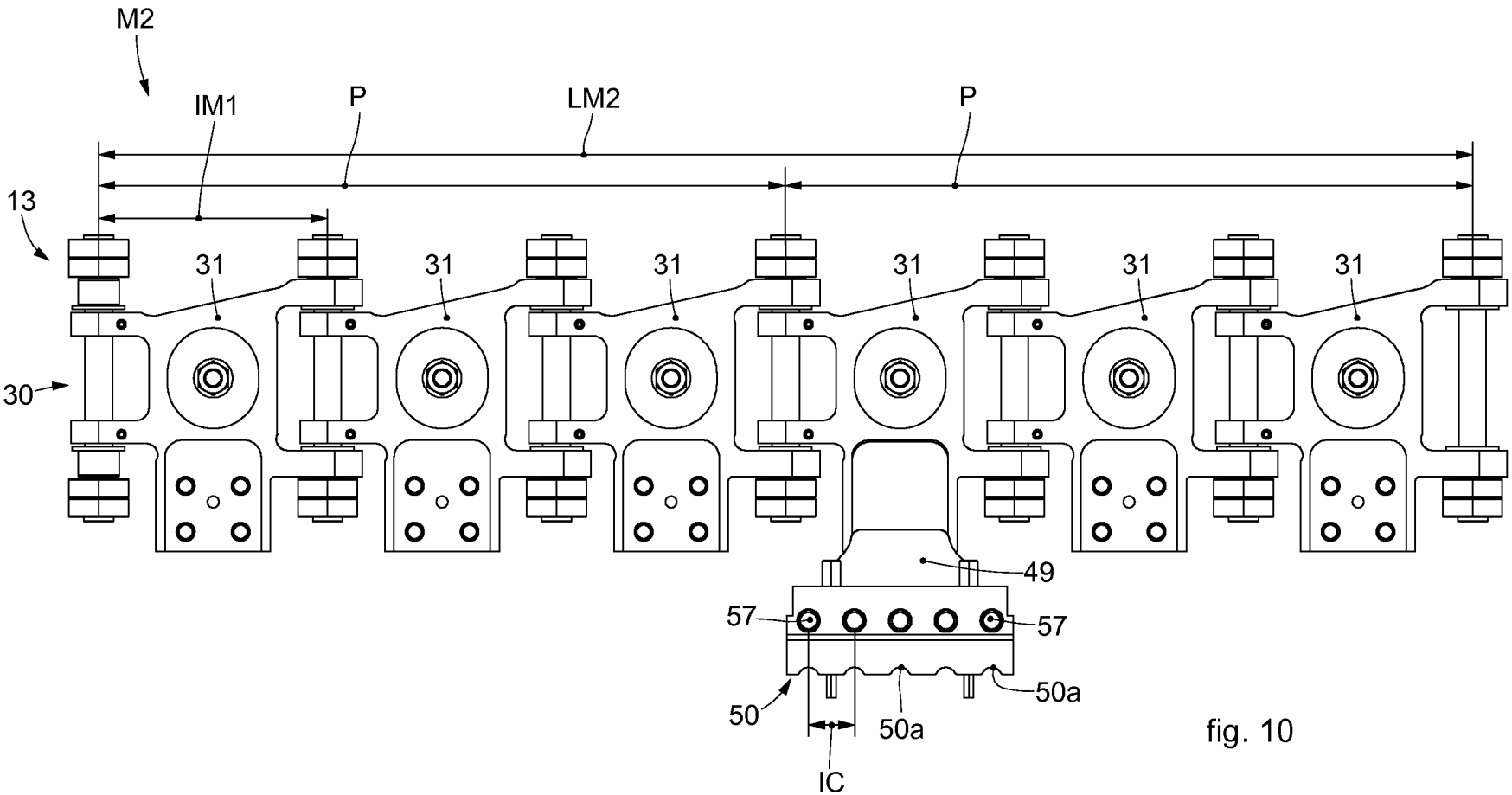
FIG. 10 is a schematic top view of a second enlarged detail of the operational module of FIG. 6.

The first transporting member 13 (FIGS. 1 and 2) is configured to selectively carry the cartomizers 201 from the first operational module M1 to the final operational module MF, passing through all the intermediate operational modules from M2 to M8, and it comprises a first chain 30 (FIGS. 8, 9 and 10) constituted by a plurality of modular elements that are identical to each other and interlinked, and that can also selectively be coupled and uncoupled, each of which comprises a link 31.

Each link 31 comprises a central plate 32 from which on one side two first arms 33 extend, parallel to the first longitudinal axis X1 and defining a recess 34, and at the opposite side two second arms 35, parallel to the first arms 33 and accommodated with some freedom of movement inside the recess 34 of the adjacent link 31. The first arms 33 and the second arms 35 are hingedly attached to each other by means of a pivot 36 that is transverse to the first longitudinal axis X1.

At the two ends of the pivot 36, outside of said first arms 33, two wheels 37 are rotatably mounted and disposed between two fixed guiding plates 38 and 39, which are present in each operational module from M1 to MF, both in the upper and in the lower path of the chain 30, and they are configured to hold with accuracy the first chain 30 in a determined vertical position. Each link 31 also comprises a third small wheel 40, arranged in the internal part of the first chain 30, which rotates in a guiding groove 41 present in the fixed guiding plate 39 and configured to hold with accuracy the first chain 30 in a determined horizontal position, i.e. at a determined distance from the first longitudinal axis X1.

The first chain 30 is stretched between a first toothed wheel 42 (FIG. 2), rotatably mounted on a fixed structure 43 of the first operational module M1 and a second toothed wheel 44 rotatably mounted on a fixed structure of the final operational module MF. The two toothed wheels 42 and 44 are arranged on a vertical plane and each is connected to a corresponding electric motor 46 and 47, schematically rendered in FIG. 2.

The two electric motors 46 and 47 are controlled by the central control unit 11 (FIG. 1), so that the first transporting member 13 advances as discrete increments, i.e. steps, and selectively carries the cartomizers 201 from the first operational module M1 to the final operational module MF, as will be explained in detail below.

On each link 31 of the first chain 30 a slider 49 (FIG. 7) is attached, which is provided with a first number N1 of vertical seats 50 (FIG. 8), each of which is suitable to receive a cartomizer 201 including, initially, the protection caps 215 and 216 (FIG. 3), but without the corresponding blocking ring 212. Preferably the first number N1 of vertical seats 50 is equal to 5.

In the embodiment described here by way of example, the interaxis IC between two adjacent vertical seats 50 (FIGS. 7 and 8), including those on the adjacent sliders 49 and therefore between two adjacent cartomizers 201 along the first longitudinal axis X1, is approximately 19 mm. Therefore the length of each slider 49, in the direction of the first longitudinal axis X1, which substantially corresponds to the interaxis IM1 between the links 31 of the first chain 30 (IM1=IC×N1), is approximately 95 mm.

The interaxis IM1 between the links 30 defines the basic dimensions for the calculation of the length, in the direction of the first longitudinal axis X1, of each operational module from M1 to MF, as well as for the pitch P (FIG. 2) of the incremental advancement of the first transporting member 13 as a result of the operation of the electric motors 46 and 47. Preferably, the length the length of each operational module from M1 to MF is equal to the interaxis IM1 multiplied by a first whole multiple MI1, preferably comprised between 3 and 21, even more preferably between 6 and 15, whereas the pitch P is equal to the interaxis IM1 multiplied by a second whole multiple MI2, equal to or smaller than MI1. Preferably the second whole multiple MI2 is equal to 3.

In the embodiment described here, the central control unit 11 (FIG. 1) is configured to have the first transporting member 13, at each pitch P, perform an incremental advancement of approximately 285 mm (P=3×IM1), so that at each pitch P a second number N2 of cartomizers 201 advances, which in the example given here is 15 (N1×MI2).

The first operational module M1, the fourth operational module M4 and the final operational module MF each preferably have a length LM1 equal to three times the pitch P, which corresponds to nine interaxes IM1, so that LM1=9×IM1=approximately 855 mm.

The second operational module M2, the fifth operational module M5, the sixth operational module M6, the seventh operational module M7 and the eighth operational module M8 each preferably have a length LM2 equal to two times the pitch P, which corresponds to six interaxes IM1, so that LM2=6×IM1=approximately 570 mm.

The third operational module M3 preferably has a length LM3 equal to five times the pitch P, which corresponds to fifteen interaxes IM1, so that LM3=15×IM1=approximately 1.425 mm.

Furthermore, with the exception of M1 and MF, in which the two toothed wheels 42 and 44 are mounted, each operational module comprises a segment of the first chain 30, both in its upper path, from the first toothed wheel 42 to the second toothed wheel 44, and in its lower path, from the second toothed wheel 44 to the first toothed wheel 42, in which each segment has a length that is equal to the interaxis IM1 for the whole multiple MI1.

In the example given here, each vertical seat 50 (FIG. 9) comprises a hemicylindrical upper part 50*a*, suitable to cooperate with a central body 202 of a cartomizer 201, and a cylindrical lower part 50*b*, suitable to accommodate the corresponding lower cap 216.

Onto each slider slider 49 also a gripping device 51 is attached, which is shaped to have N1 hemicylindrical recesses 51*a*, opposite to and mirroring the group of N1 upper parts 50*a*, to selectively and contemporaneously grip in the desired position the corresponding N1 central bodies 202 of the cartomizers 201, controlled by the central control unit 11 (FIG. 1), as will be described in detail below.

The removal means 15 that remove the caps 215 and 216 from the central bodies 202 of the cartomizers 201, in the example given here, is configured to treat N2 cartomizers 201 at the same time, i.e. the number of cartomizers supported by MI2 adjacent sliders 49 (the three on the far right in FIG. 8) and it comprises temporary blocking means 52, having a horizontal comb-like element 53 provided, on the side facing the vertical seats 50, with recesses 54 whose interaxis is equal to that of said vertical seats 50 and a width that is slightly greater than the external diameter of a central body 202 (FIG. 3) of a cartomizer 201, but smaller than the external diameter of a lower cap 215.

The removal means 15 also comprise a first gripping and positioning device 55 (FIGS. 6, 7 and 9), for example of the type known to experts of the field as "pick and place", or "P&P", which has N2 grippers 56 that are selectively operable, under the control of the central control unit 11 (FIG. 1), both for being lifted and lowered all at the same time, and also for each gripping an upper cap 216 (FIG. 7), with or without the associated central body 202 of a corresponding cartomizer 201, as will be described in detail below.

The first gripping and positioning device 55 is also configured to contemporaneously transport N2 upper caps 216, after having been lifted and removed from the central bodies 202, along a first transverse axis Y1 (FIG. 9), substantially horizontal, and to lower them onto N2 corresponding vertical pegs 57 with a cylindrical shape, mounted on the upper part of the slider 49 each having an external diameter that is slightly smaller than the internal diameter of each upper cap 216. The interaxis between two adjacent vertical pegs 57 (FIG. 8) is equal to the interaxis IC between two vertical seats 50 of the sliders 49.

The central control unit 11 (FIG. 1) is programmed so that the removal means 15 described above remain inactive during an initial stage of each operational cycle, in the course of which the first transporting member 13 is made to advance a determined third number N3 of pitch P, in which N3 is for example 8, as will be described in detail below. Instead, during this initial stage, the central control unit 11 controls and operates the storage means 16.

Figure 11:
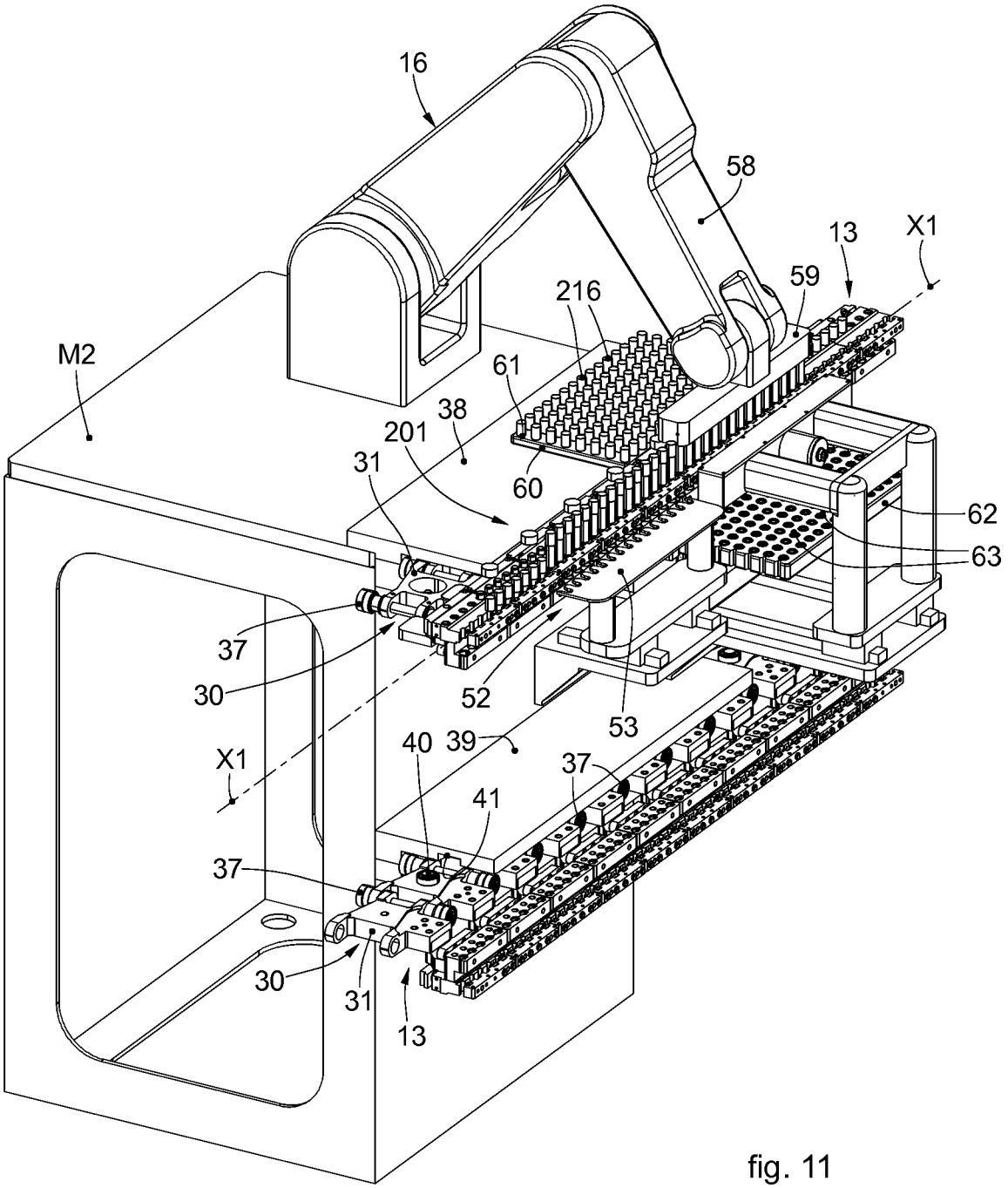
FIG. 11 is a perspective view of a part of the operational module of FIG. 6.
Figure 12:
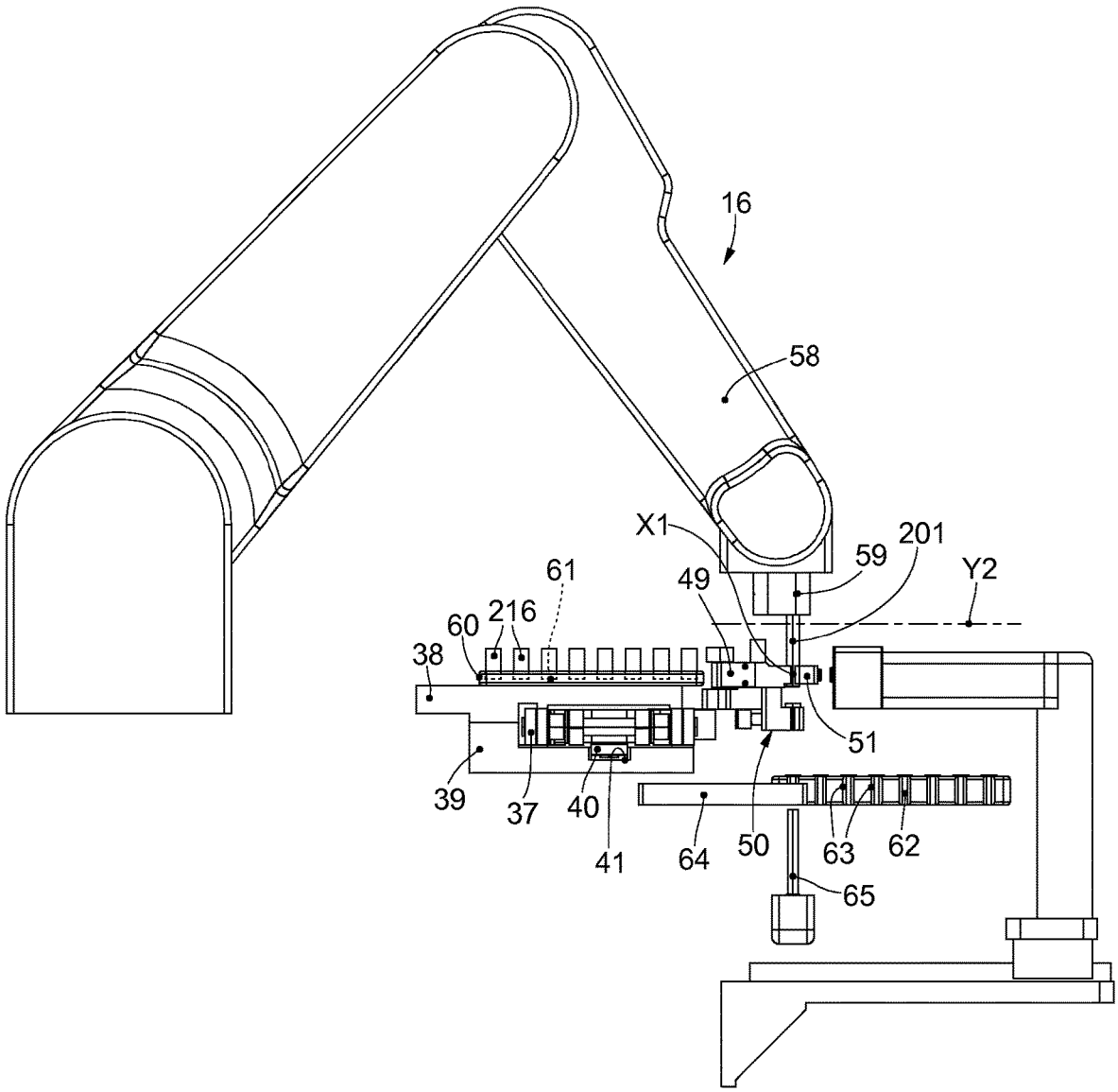
FIG. 12 is a transverse cross section along the line XII-XII of FIG. 1.

In particular the storage means 16 (FIGS. 11 and 12) comprise, in the upper part, a second gripping and positioning device 58, also of the P&P type, which is provided with N2 selectively operable grippers 59 both to be lifted and lowered all at the same time, and each to grip an upper cap 216 (FIG. 12) still positioned on the corresponding central body 202 of a cartomizer 201.

The second gripping and positioning device 58 is also configured to selectively and contemporaneously transport N2 upper caps 216, after having been lifted and removed from the central bodies 202, along a second transverse axis Y2, parallel to the first transverse axis Y1, and to lower them onto a plurality of vertical seats 60 of a fixed horizontal upper tray 61. The vertical seats 60 are arranged according to a regular matrix of N3 rows, parallel to the first longitudinal axis X1, by N2 columns, perpendicular to the first longitudinal axis X1. The interaxis between two adjacent vertical seats 60 is equal to the interaxis IC between two vertical seats 50 of the sliders 49.

Furthermore the storage means 16 (FIGS. 11 and 12) comprise a lower tray 62, horizontal, horizontally movable and provided with a plurality of vertical through seats 63 also arranged according to a regular matrix of N3 rows, parallel to the first longitudinal axis X1, by N2 columns, perpendicular to the first longitudinal axis X1. Also the interaxis between two adjacent vertical seats 63 is equal to the interaxis IC between two vertical seats 50 of the sliders 49.

A transfer device 64 (FIG. 12) is configured to horizontally move the lower tray 62 parallel to the second transverse axis Y2, to selectively position each of the N3 rows in the vertical seats 63 at the overhanging vertical seats 50 of the sliders 49. In a fixed position, underneath the transfer device 64 and at the vertical seats 50 of the sliders 49, a group of N2 suction tubes 65 is positioned that is configured to selectively and contemporaneously apply suction on the N2 lower caps 215 through the corresponding row of vertical seats 63 of the lower tray 62 and remove them in a downwards direction from the central bodies 202 of N2 cartomizers 201 positioned in the vertical seats 50 of the sliders 49, to set them down temporarily in the vertical seats 63 of the lower tray 62.

The filling means 17 (FIGS. 13 to 20) comprise a fixed structure 66 arranged before the first transporting member 13 and having a vertical wall 67, substantially parallel to the first longitudinal axis X1, and a horizontal rest support 68.

On the anterior part of the vertical wall 67 a third toothed wheel 69 (FIGS. 2 and 13) and a fourth toothed wheel 70 are rotatably mounted, arranged horizontally aligned on a vertical plane parallel to a vertical plane passing through the first longitudinal axis X1.

Onto the toothed wheels 69 and 70 the second transporting member 19 is mounted, configured for example as a second chain 71, made of second links 72 connected in an articulated manner to each other.

Figure 13:
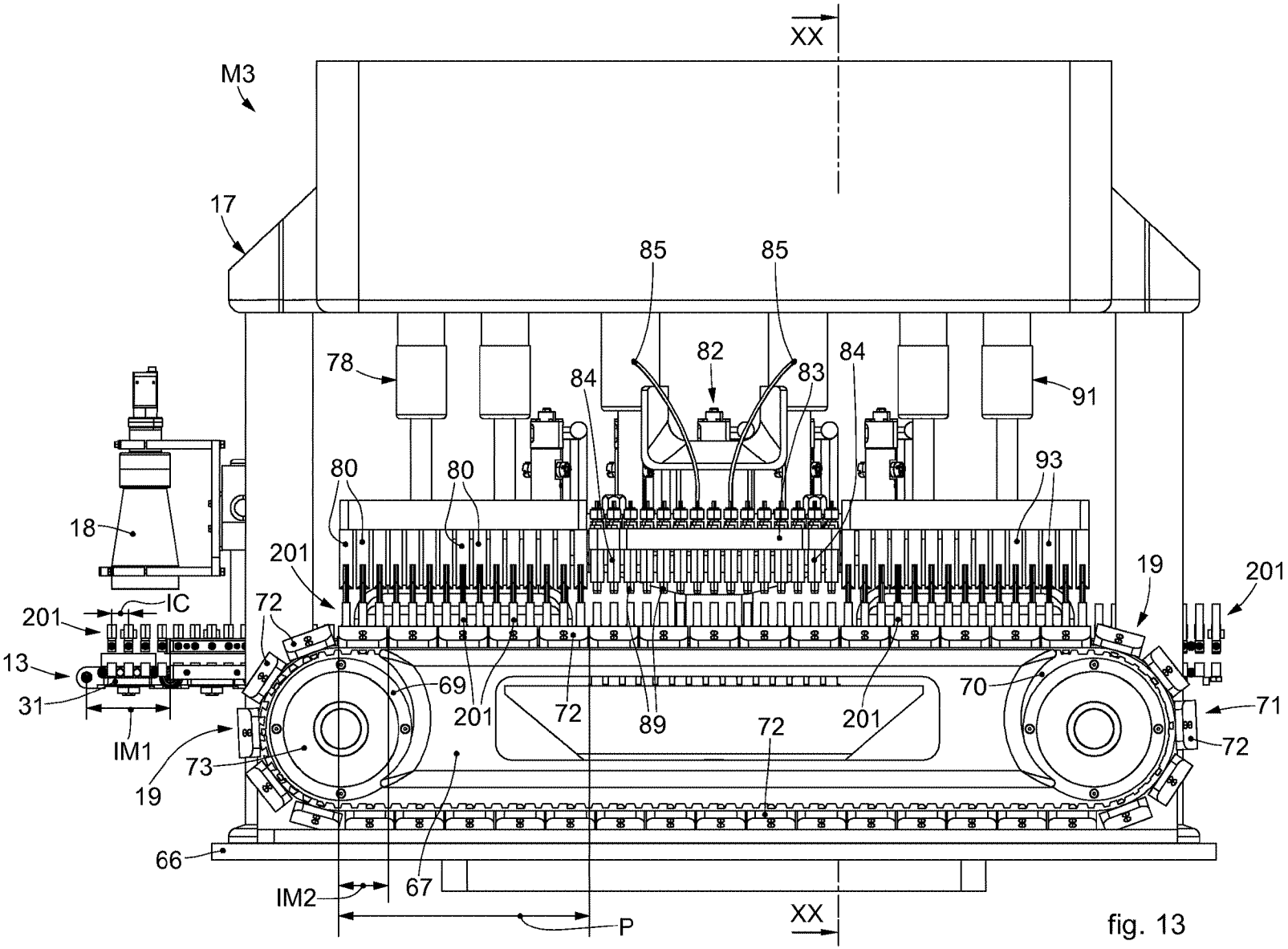
FIG. 13 is a front enlarged view of another operational module of the machine of FIG. 1.

A third electric motor 73, schematically rendered in FIG. 13 and controlled, for example, by the same central control unit 11, is connected to the two toothed wheels 69 and 70 to bring them selectively to rotate in a clockwise direction so that the second chain 71 performs incremental advances having the same pitch P as the first transporting member 13. Alternatively, the third electric motor 73 can be controlled by another control unit, not represented in the drawings, as long as this motor is synchronised with the electric motors 46 and 47. Furthermore, instead of a single electric motor 73, two electric motors 73 could be provided (not represented in the figures), one of which is associated with the third toothed wheel 69 and the other with the fourth toothed wheel 70.

Different from the links 31 of the first chain 30, each second link 72 of the second chain 71 is shorter in length and the interaxis IM2 between two adjacent second links 72 is equal to pitch P divided by a whole submultiple SM, which in the example given here is five, so that the interaxis IM2 is approximately 57 mm.

Each second link 72 comprises a plurality of cylindrical seats 74 (FIG. 14), arranged according to a regular matrix consisting of a fourth number N4 of rows, for a fifth number N5 of columns, in which N4 is for example 3, whereas N5 is equal to IM2/IC, i.e. three in the example given here, so that there are nine cylindrical seats 74 per second link 72 in the example given here. The cylindrical seats 74 are configured to assume a vertical position when they are perpendicular to the first longitudinal axis X1, each accommodating a cartomizer 201. The interaxis between two adjacent cylindrical seats 74 is equal to the interaxis IC between two adjacent vertical seats 50 of the sliders 49. Therefore, in the example given here, at each pitch P the second transporting member 19 is able to advance a sixth number N6 of cartomizers 201 at a time, in which N6 is equal to N2×N4, so that in the example given here N6=15×3=45.

The rest support 68 is provided on its left side, i.e. the side towards the second operational module M2 (FIG. 1), with a first group of fixed vertical seats 75 (FIG. 14), equal in number to said second number N2, aligned in a single row that is parallel to the first longitudinal axis X1, to temporarily accommodate said second number N2 of cartomizers 201 that are to be filled with the liquid, and on the right side, i.e. towards the fourth operational module M4 (FIG. 1), with a second group of fixed vertical seats 76 (FIG. 20), also equal in number to said second number N2, aligned with the fixed vertical seats 75 and configured to temporarily accommodate said second number N2 of cartomizers 201 already filled with said liquid. The interaxis between two adjacent fixed vertical seats 75 and between two adjacent fixed vertical seats 76 are both equal to the interaxis IC between two adjacent vertical seats 50 of the sliders 49.

The filling means 17 also comprise a third gripping and positioning device 77 (FIGS. 14 and 16) and a fourth gripping and positioning device 78, also of the P&P type, which are aligned along a third transverse axis Y3 (FIG. 16), parallel to the first transverse axis Y1.

Each gripping and positioning device 77 and 78 is provided with a number of grippers 79 and 80 respectively, equal in number to said second number N2 of cartomizers 201. The grippers 79 and 80 are selectively operable, under the control of the central control unit 11, both for being lifted and lowered all at the same time, and for each to grip a cartomizer 201, as will be described in detail below.

In particular, the third gripping and positioning device 77 is also configured to contemporaneously transfer N2 cartomizers 201 at a time, along the third transverse axis Y3, after having lifted them from the vertical seats 50 of the sliders 49, and then to place them, by contemporaneously lowering them onto the corresponding fixed vertical seats 75, as will be described in detail below, to be weighed individually by a corresponding load cell 81 of the first weighing device 20.

The fourth gripping and positioning device 78 on the other hand is configured to contemporaneously transfer N2 cartomizers 201 at a time, along the third transverse axis Y3, and then to place them, by contemporaneously lowering them on the corresponding cylindrical seats 74 of the second links 72, after having lifted them from the fixed vertical seats 75, as will be described in detail below.

Furthermore, the filling means 17 comprise an injection device 82 (FIGS. 13 to 17), which comprises a support 83, vertically movable, onto which a plurality of injectors 84 is mounted, whose number is equal to said sixth number N6 di cartomizers 201, arranged in a regular manner on a matrix of N4 rows parallel to the first longitudinal axis X1, for N2 columns, to contemporaneously insert by injection said liquid into N6 cartomizers 201 at a time. The interaxis between two adjacent injectors 84 is equal to the interaxis between two adjacent cylindrical seats 74 of the second links 72, which, as was described earlier, is equal to the interaxis IC between two adjacent vertical seats 50 of the sliders 49.

Each injector 84 is connected, by means of a conduit 85, to a pump 86 (FIG. 15) of a pumping unit 87 (FIGS. 1 and 15) arranged in a posterior zone with respect to the second transporting member 19 and also comprising a tank 88 (FIG. 15) for the liquid that is to be injected.

Furthermore, each injector 84 comprises a lower head 89 (FIG. 18), having an external diameter that is slightly smaller than the internal diameter of the internal cavity 203 of a cartomizer 201, and three vertical injection needles 90 arranged at angular offsets to each other of 120° (FIGS. 18 and 19) and at a certain distance, or radius, R (FIG. 19) from a central vertical axis Z, so that they can contemporaneously be inserted into the felted cloth 2111 of a cartomizer 201, between the tubular element 209 and the bushing 210 to inject into said felted cloth 2111 the liquid coming from the pumping unit 87. In the example given here the radius R is approximately 3.25 mm.

The support 83 (FIG. 13) is configured to move vertically between a rest position, raised, in which all the lower heads 89 of the N6 injectors 84 are completely outside of the N6 cartomizers 201 underneath, and a lowered operational position (not represented in the drawings), in which all the lower heads 89 of the N6 injectors 84 are completely inside the upper part of the internal cavity 203 of the N6 cartomizers 201 underneath.

Additionally, the injection device 82 is configured so that the injection needles 90 of all the N6 injectors 84 are also contemporaneously movable between an inactive position, in which their tips are inside the corresponding lower head 89 (FIG. 18), and an active position (FIG. 19), in which they have exited from the latter and are inside the corresponding felted cloth 2111 to inject the liquid into it.

The filling means 17 furthermore comprise a fifth gripping and positioning device 91 and a sixth gripping and positioning device 92 (FIGS. 13 and 20), analogous to the gripping and positioning means 55, 58, 77 and 78, which are, however, aligned along a fourth transverse axis Y4 (FIG. 20), parallel to the first transverse axis Y1 and arranged downstream from the injection device 82, i.e. towards the fourth operational module M4 (FIG. 1).

Each gripping and positioning device 91 and 92 is provided with a number of grippers 93 and 94 respectively, equal in number to said second number N2 of cartomizers 201. The grippers 93 and 94 are selectively operated, under the control of the central control unit 11, both to be raised and lowered all together, and to each grip a cartomizer 201, as will be described in detail below.

In particular, the fifth gripping and positioning device 91 is also configured to contemporaneously transfer, along the fourth transverse axis Y4, N2 cartomizers 201 at a time, after the liquid has been injected into the latter, and they have been lifted from the cylindrical seats 74 of the second links 72, to place them, by contemporaneously lowering them, on the N2 fixed vertical seats 76, as will be described in detail below, to be weighed individually by a corresponding load cell 95 of the second weighing device 21.

The sixth gripping and positioning device 92 on the other hand is configured to contemporaneously transfer N2 cartomizers 201 at a time along the fourth transverse axis Y4 and then to place them, by contemporaneously lowering them, on the corresponding N2 vertical seats 50 of the sliders 49, after having lifted them from the fixed vertical seats 76, as will be described in detail below.

The repositioning means 27 (FIGS. 21 to 24) for the repositioning of the caps 215 and 216 on the central bodies 202 of the cartomizers 201 is subdivided into two parts placed side by side along the first longitudinal axis X1, i.e. a first part 27A, nearest to the seventh operational module M7 and configured to insert N2 tubular bodies 202 at a time into N2 corresponding lower caps 215, and a second part 27B, nearest to the final operational module MF and configured to then insert N2 upper caps 216 at a time into the N2 corresponding tubular bodies 102, already inserted into the lower caps 215.

In the embodiment represented here, the first part 27A comprises a pushing device 96 (FIGS. 21 and 23), configured to selectively push down, under the control of the central control unit 11, the N2 tubular bodies 202 that are carried by the sliders 49 and located underneath it, in such a manner as to insert them into the corresponding lower caps 215 that are positioned in the corresponding lower parts 50*b* of the vertical seats 50.

The second part 27B (FIGS. 21 and 24) instead comprises a seventh gripping and positioning device 97, also of the P&P type, which is provided with N2 selectively operable grippers 98, under the control of the central control unit 11, to grip N2 upper caps 216 positioned onto the vertical pegs 57, remove them from the latter, lift them, and then transport the upper caps 216 along a fifth transverse axis Y5, parallel to the first transverse axis Y1, until they reach the N2 central bodies 202, and then inserted by lowering them to cover the upper parts of the latter, as will be described in detail below.

In the eighth module M8 also a device of the known kind, not represented in the drawings, can be arranged that is configured to remove from the first chain 30 cartomizers 201 that are faulty or that have not been correctly filled in the third operational module M3.

Figure 27:
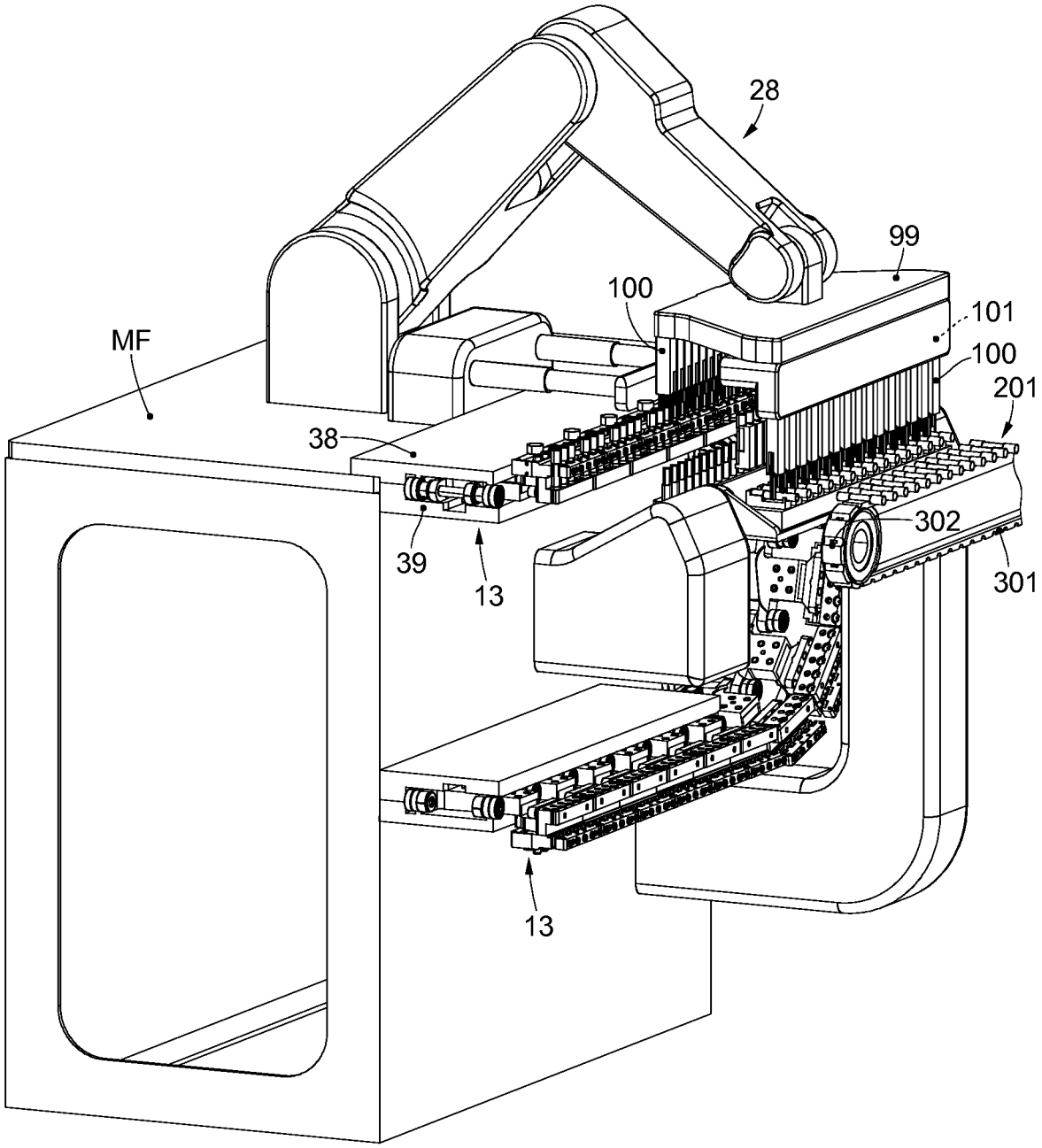
FIG. 27 is a perspective view of the operational module of FIG. 25.
Figure 28:
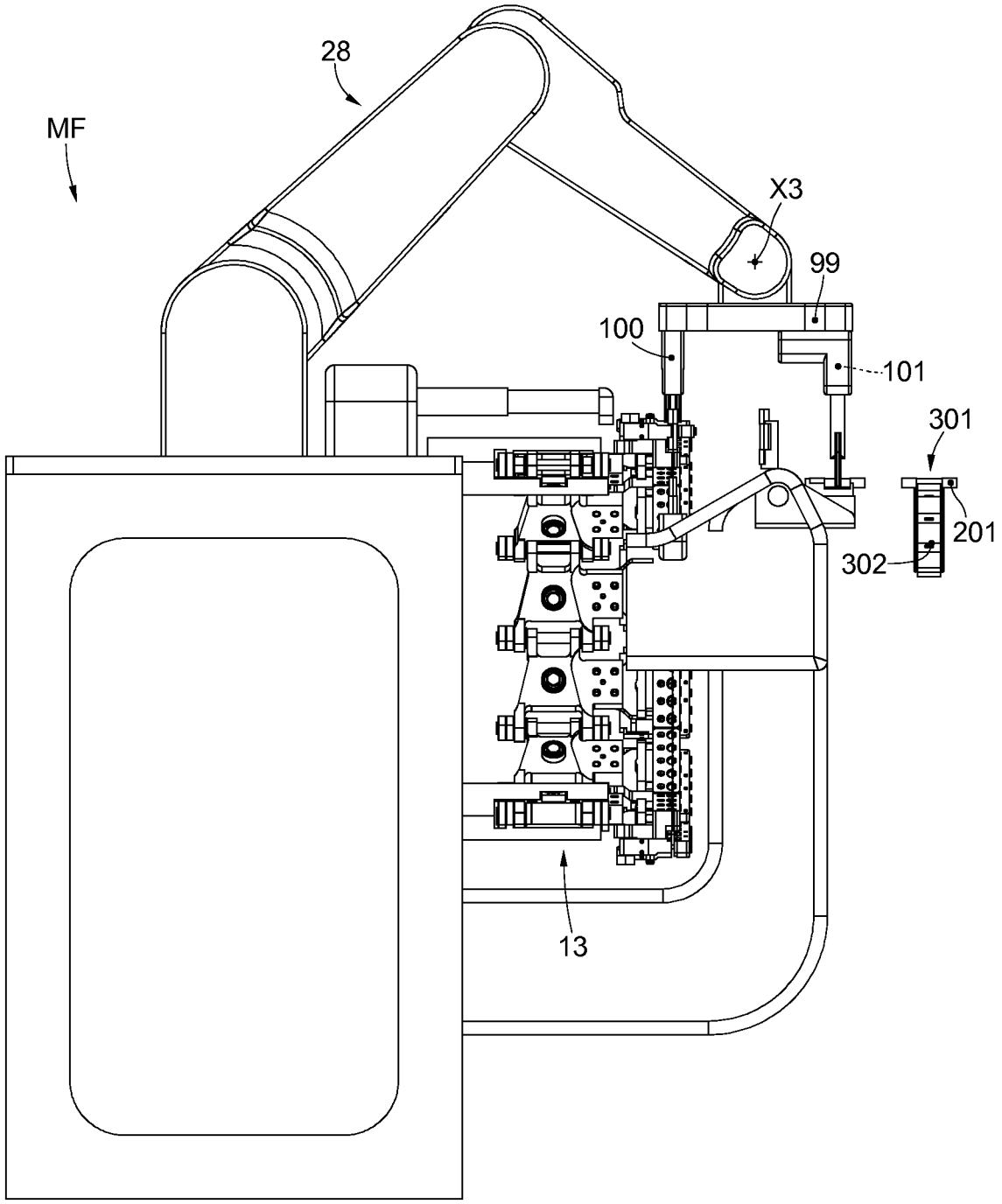
FIG. 28 is a left side view of the operational module of FIG. 25.

The transfer means 28 (FIGS. 27 to 28) comprise a transfer device 99 configured to transfer, under the control of the central control unit 11, N2 cartomizers 201 at a time, including their lower caps 215 and upper caps 216, from the vertical seats 50 of the links 31 of the first chain 30, to corresponding horizontal seats 302 of the third transporting member 301, having an interaxis IS between them that is greater than the interaxis IC between the vertical seats 50.

The transfer device 99 is similar to a P&P device described above and it comprises N2 grippers 100, configured to each selectively grip a corresponding cartomizer 201, as well as an internal mechanism 101 configured to distance the N2 grippers 100, so that the distance between the cartomizers 201 is increased until it reaches that of the interaxis IS of the horizontal seats 302 of the third transporting member 301.

Figure 25:
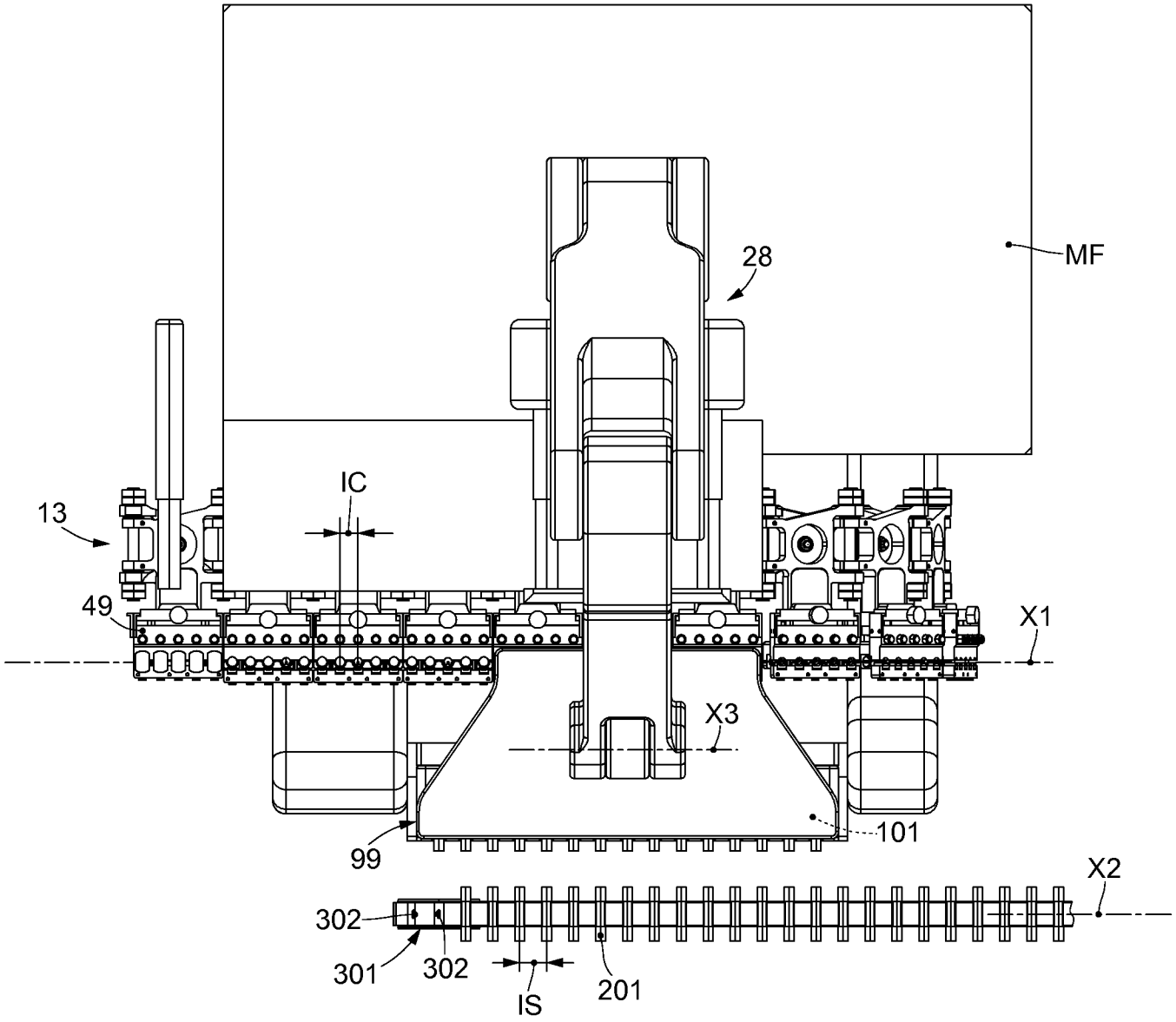
FIG. 25 is a top view of a further operational module if the machine of FIG. 1.
Figure 26:
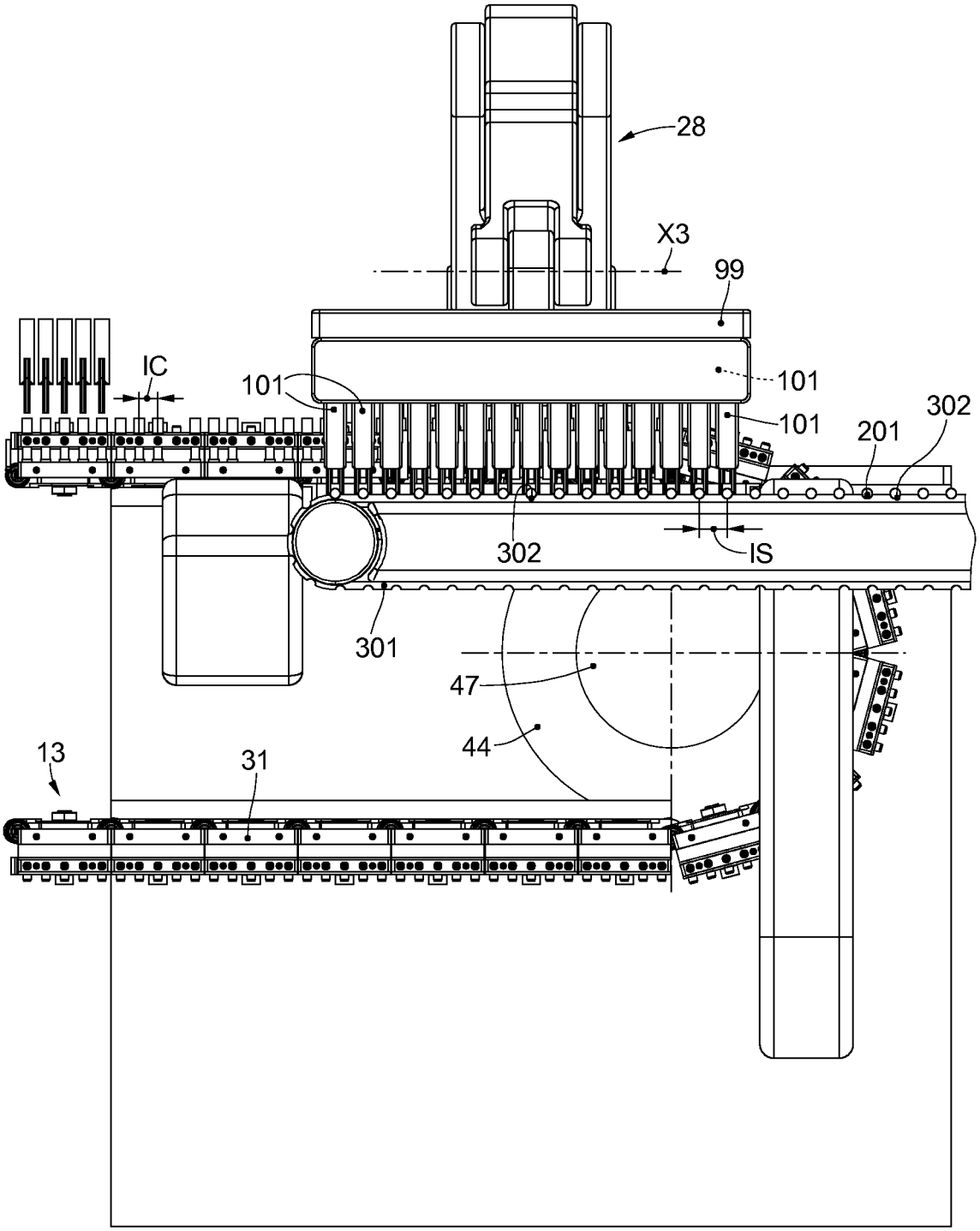
FIG. 26 is a front view of the operational module of FIG. 25.

In particular the transfer device 99 is configured to perform a rotation by 270° in a clockwise direction (FIG. 28) with respect to an axis of rotation X3 parallel to the first longitudinal axis X1 (FIG. 25).

The functionality of the machine 10 described so far, which also defines the method for the automatic treatment of components of inhalers, in particular cartomizers 201 for electronic cigarettes, is as follows.

In a first operational stage, also known as loading stage, the cartomizers 201 that are to be treated and/or inspected, including the caps 215 and 216, are arranged by the loading device 12 (FIGS. 1 and 2) onto the first transporting member 13, for example automatically by means of robot means of the known kind, controlled by said central control unit 11. In particular, each cartomizer 201 is positioned vertically in a corresponding vertical seat 50, with the lower cap 215 inside the lower part 50*b* (FIG. 9) of the latter.

In a second operational stage, also known as transfer stage, the electric motors 46 and 47 (FIG. 2) receive commands from the central control unit 11 in order to have the first chain 30 rotate in a clockwise direction and perform a rapid incremental advancement of pitch P equal in length to the size of three adjacent sliders 49 (FIG. 7), i.e. approximately 285 mm, to carry N2 cartomizers 201, i.e. N1 for each of the three sliders 49, from the first operational module M1 (FIG. 2) to the removal means 15.

By way of example the speed of advancement V of the chain 30 is very high, so that each incremental advancement corresponding to a pitch P is carried out very rapidly for each time interval T1, which in the example given here is approximately 0.9 seconds, so that the machine 10 can obtain a productivity of approximately 1.000 cartomizers 201 per hour.

In a third operational stage, also known as removal stage, first the lower caps 215 and upper caps 216 are removed from the corresponding central bodies 202 of each of the N2 cartomizers 201 that are temporarily in the second operational module M2. This removal operation, during an initial stage, i.e. at the beginning of the treatment of a specific batch, or quantity, of cartomizers 201, is performed, under the control of the central control unit 11, by the storage means 16 (FIG. 6) and then, after N3 steps of pitch P, by the removal means 15. The same storage means 16 will again be operational during the final N3 steps of pitch P, to position onto the sliders 49 both the lower caps 215, and the upper caps 216, temporarily stored in the trays 62 and 61 respectively.

In particular, during the initial stage, a first group of N2 lower caps 215 is lifted by the N2 suction tubes 65 (FIG. 12), which deposit them in a first row of the N2 vertical seats 63 of the lower tray 62. Contemporaneously the second gripping and positioning device 58, with its N2 grippers 59, lifts N2 upper caps 216 and positions them on a first row of the vertical seats 60 of the upper tray 61, for example the one farthest from the first longitudinal axis X1.

Then the first chain 30 is made to advance by another pitch P and this operation is repeated on a subsequent group of N2 cartomizers 201, prior to the moving by one step of the lower tray 62, by means of the transfer device 64, so that the lower caps 215 are arranged in a second row of the N2 vertical seats 63 of the same lower tray 62. Contemporaneously the second gripping and positioning device 58 takes, with its N2 grippers 59, a subsequent group of N2 upper caps 216 and positions them on a second row of the vertical seats 60 of the upper tray 61, for example adjacent to the first row.

This is repeated for a total of N3 times, until the upper tray 60 and lower tray 62 are filled.

From here, the first N3 sliders 49 move from the second operational module M2 to the third operational module M3 carrying only the central bodies 202 of the cartomizers 201, i.e. without the lower caps 215 and upper caps 216. The latter will be returned to the N3 sliders 49 after the last group of cartomizers 201 of the batch to be treated, loaded onto the first chain 30, with an operation that is the inverse of the storage means 16, under the control of the central control unit 11.

After said initial stage, the central control unit 11 controls and operates the removal means 15, whereas the storage means 16 are kept inactive.

In particular, the central control unit 11 first sends a command to the temporary blocking means 52 (FIGS. 6, 8 and 9) so that the N2 lower caps 215 are held in their initial positions at the bottom of the corresponding lower parts 50*b* (FIG. 5*a*) of the vertical seats 50 and at the same time distances the gripping device 51 (FIGS. 7 and 8) from the upper parts 50*a* of the vertical seats 50. Then the central control unit 11 sends a command to the first gripping and positioning device 55 so that, with their grippers 56 (FIG. 7), the N2 upper caps 216 are all gripped at the same time and lifted together with the central bodies 202, at a first height first height Q1 (FIG. 5*b*), higher than the height of the lower caps 215 i.e. until the lower caps 215 are removed completely from said central bodies 202, which are still provided with their upper caps 216. Immediately after this the central control unit 11 activates the gripping device 51 (FIGS. 7 and 8) and blocks the N2 central bodies 202 in the upper parts 50*a* of the vertical seats 50.

The first gripping and positioning device 55 then further lifts the N2 upper caps 216, bringing them to a second height Q2 (FIG. 5*c*) from the initial position, thus removing them completely from the corresponding central bodies 202 that remain stationary at the first height Q1 (FIG. 5*b*) held by the horizontal comb-like element 53.

Subsequently the central control unit 11 sends a command to the first gripping and positioning device 55 so that the N2 upper caps 216 that have just been removed, are positioned, in other words temporarily parked, on the vertical pegs 57 by moving them along the first transverse axis Y1 and then lowering them.

During the third operational stage, other cartomizers 201 to be treated and/or inspected, including the caps 215 and 216, are arranged in the first chain 30 by means of the loading device 12 (FIG. 1 e 2).

In a fourth operational filling stage for filling, the electric motors 46 and 47 (FIG. 2) receive commands from the central control unit 11 to make the first chain 30 perform further steps at pitch P to carry groups of N2 central bodies 202 without the caps 215 and 216, to the filling means 17 to carry out the filling of the cartomizers 201, as follows.

Holding the first transporting member 13 as well as the second transporting member 19 stationary, a removal step is performed which includes a first transfer step to transfer, along the third transverse axis Y3 (FIG. 16), a first group of N2 cartomizers 201 until they are carried contemporaneously, by means of the third gripping and positioning device 77, from the vertical seats 50 of the sliders 49 to the fixed vertical seats 75 of the rest support 68, where each cartomizer 201 is weighed by a corresponding load cell 81 of the first weighing device 20. The weight, i.e. the tare of each cartomizer 201 is stored in the central control unit 11.

Then, while the second transporting member 19 still remains stationary, the first transporting member 13 is made to advance by an additional pitch P (FIG. 2), so that a second group of N2 cartomizers 201 is carried, immediately after the first one, to said removal position.

Then a second transfer step is executed by means of the third gripping and positioning device 77 to transfer, along the third transverse axis Y3 (FIG. 16), the second group of N2 cartomizers 201 until they are carried from the vertical seats 50 of the sliders 49 to the fixed vertical seats 75 of the rest support 68. Contemporaneously the fourth gripping and positioning device 78 transfers the first group of N2 cartomizers 201 along the third transverse axis Y3 until they are carried from the fixed vertical seats 75 to the outermost row, i.e. the one on the far right in FIG. 16, of the cylindrical seats 74 of the second links 72 of the second chain 70.

Then, while the second transporting member 19 still remains stationary, the first transporting member 13 is made to advance by an additional pitch P (FIG. 2) so that a third group of N2 cartomizers 201 is carried, immediately after the second one, to said removal position.

Then a third transfer step is executed to transfer, along a third transverse axis Y3 (FIG. 16), the third group of N2 cartomizers 201 and to bring it, by means of the third gripping and positioning device 77, from the vertical seats 50 of the sliders 49 to the fixed vertical seats 75 of the rest support 68. Contemporaneously, the fourth gripping and positioning device 78 transfers the second group of N2 cartomizers 201 along the third transverse axis Y3 until it is carried from the fixed vertical seats 75 to the middle row of the cylindrical seats 74 of the second links 72 of the second chain 70.

Then, while the second transporting member 19 still remains stationary, the first transporting member 13 is made to advance by an additional pitch P (FIG. 2), so that a fourth group of N2 cartomizers 201 is carried, immediately after the third one, to said removal position.

Then a fourth transfer step is executed to transfer, along the third transverse axis Y3 (FIG. 16), the fourth group of N2 cartomizers 201 and to carry it, by means of the third gripping and positioning device 77, from the vertical seats 50 of the sliders 49 to the fixed vertical seats 75 of the rest support 68. Contemporaneously, the fourth gripping and positioning device 78 transfers the third group of N2 cartomizers 201 along the third transverse axis Y3 until it is carried from the fixed vertical seats 75 to the innermost row, i.e. the one on the far left in FIG. 16, of the cylindrical seats 74 of the second links 72 of the second chain 70.

Then a further advancement by an additional pitch P towards the final operative module MF is performed on both the first transporting member 13, so that it a fifth group of N2 cartomizers 201 to the removal position, and on the second transporting member 19, so that the N6 cartomizers 201 previously positioned in the cylindrical seats 74 (FIG. 16) of the second links 72, i.e. N2 for each of the N4 rows, are contemporaneously moved to the right (FIG. 13) until they are brought to the N6 injectors 84 of the injection device 82.

It should be noted that thanks to said removal step of the 201 and their transfer from the first transporting member 13 to the second transporting member 19, the N6 cartomizers 201 positioned on the latter are made to advance by a pitch P at a frequency that is 1/N4, i.e. a third in the example given here, of that for the advancement of the N2 cartomizers 201 positioned on the first transporting member 13, so that the N6 cartomizers 201 remain stationary in the injection device 82 for an injection time T2, which is N4 times the time interval T1. Therefore, in the example given here, said injection time T2 is approximately 2.7 seconds, which is long enough to execute the actual injection step, which allows the necessary quantity of liquid to be injected into each of the N6 cartomizers 201.

Then the actual injection step is executed, which comprises a first injection sub-step in which the support 83 and the N6 injectors 84 are lowered so that their lower heads 89 (FIGS. 17 and 18) enter into the corresponding axial cavities 13 of the N6 cartomizers 201. Then all the N6 times three injection needles 90 are lowered, until they are brought, three for each cartomizer 201, in the lowest part of the felted cloths 211 of the latter. Then the pumps 86 (FIG. 15) are activated so that into the felted cloths 211 (FIGS. 18 and 19) the liquid contained by the tank 88 (FIG. 15) is injected. While the pumps 86 continue to operate, all the injection needles 90 (FIG. 18) are advantageously lifted upwards gradually, or by incremental steps, so that the felted cloth 211 of each cartomizer 201 is thoroughly imbued.

After the pumps 86 (FIG. 15) have ceased operation, all the injection needles 90 are contemporaneously brought to the inactive position (FIG. 18), and the support 83 with all the N6 injectors 84 is brought to the rest position.

During the injection step, the second transporting member 19 remains stationary, while the first transporting member 13 continues to advance at pitch P (FIG. 2) at a time, for N4 more turns. Contemporaneously the two gripping and positioning means 77 and 78 (FIG. 16) transfer other N6 cartomizers 201 (N2 at a time) from the first transporting member 13 to the rest support 68 and from there to the second links 72 of the second transporting member 19, in the manner described previously. In this manner, during the injection step, other N6 cartomizers 201 are positioned in just as many cylindrical seats 74 of the second links 72.

After the injection step is finished, also the second transporting member 19 is made to advance by a further pitch P towards the right (FIG. 13), so that the N6 cartomizers 201 that have just been filled with liquid are taken to a position for the removal from the second transporting member 19.

Then a removal step is executed on the N6 cartomizers 201 that have just been filled with liquid, to carry them, N2 at a time, into the vertical seats 50 of the sliders 49 of the first transporting member 13. In particular, while the second transporting member 19 remains stationary for a time equal to the injection time T2 and the first transporting member 13 remains stationary for a time interval T1, a fifth transfer step is executed in which the fifth gripping and positioning device 91 (FIG. 20) takes with its grippers 93 and then transfers, along the fourth transverse axis Y4, the third group of N2 cartomizers 201 to carry it from the innermost row, i.e. the one on the far right in FIG. 20, of the cylindrical seats 74 of the second links 72 in which it was located, to the fixed vertical seats 76 of the rest support 68.

Then, while the second transporting member 19 still remains stationary, the first transporting member 13 is made to advance by a further pitch P (FIG. 2) towards the right. Then a sixth transfer step is executed, in which the sixth gripping and positioning device 92 (FIG. 20) takes with its grippers 94 and then transfers, along the fourth transverse axis Y4, the third group of N2 cartomizers 201 to carry it from the fixed vertical seats 76 of the rest support 68 to the vertical seats 50 of the sliders 49.

It should be noted that with the removal step described above, thanks to the operation first of the storage means 16 and then of the removal means 15, N2 lower caps 215 and N2 upper caps 216 will be present in the corresponding slider 49 on which the third group of N2 cartomizers 201 is positioned.

Contemporaneous with the operation of the sixth gripping and positioning device 92 just described, the fifth gripping and positioning device 91 takes with its grippers 93 and then transfers, along the fourth transverse axis Y4, the second group of N2 cartomizers 201 to carry it from the middle row of the cylindrical seats 74 of the second links 72, in which it was located, to the fixed vertical seats 76 of the rest support 68.

Then, while the second transporting member 19 still remains stationary, the first transporting member 13 is made to advance by a further pitch P (FIG. 2) towards the right. Then a seventh transfer step is executed in which the sixth gripping and positioning device 92 (FIG. 20) takes with its grippers 94 and then transfers, along the fourth transverse axis Y4, the second group of N2 cartomizers 201 to carry it from the fixed vertical seats 76 of the rest support 68 to the vertical seats 50 of the sliders 49. Contemporaneously the fifth gripping and positioning device 91 takes with its grippers 93 and then transfers, along the fourth transverse axis Y4, the first group of N2 cartomizers 201 to carry it from the outermost row, i.e. the one on the far right in FIG. 20, from the cylindrical seats 74 of the second links 72, in which it was located, to the fixed vertical seats 76 of the rest support 68.

Then, while the second transporting member 19 still remains stationary, the first transporting member 13 is made to advance by a further pitch P (FIG. 2) towards the right. Then an eighth transfer step is executed in which the sixth gripping and positioning device 92 (FIG. 20) takes with its grippers 94 and then transfers, along the fourth transverse axis Y4, the first group of N2 cartomizers 201 to carry it from the fixed vertical seats 76 of the rest support 68 to the vertical seats 50 of the sliders 49.

The steps of transfer, injection, and removal as described here then repeat in continuity as long as there are cartomizers 201 to fill with the desired liquid.

Then one or more operational or inspection steps follow, in the course of which on the groups of N2 cartomizers 201 still without the caps 215 and 216, exiting from the third operational module M3 the desired operations and/or inspections are carried out in the operational modules from M4 (FIGS. 1 and 2) to M7.

Associated with each operational and/or inspection step a further transport step is provided, analogous to the ones described above, in which by means of the first transporting member 13, with incremental advancements at pitch P, the cartomizers 201 are transferred from the third operational module M3 to the eighth operational module M8, where the repositioning step of the caps 215 and 216 in the central bodies 202 of the cartomizers 201 is executed, as follows.

In the eighth operational module M8 (FIGS. 21, 22 and 23), the repositioning means 27, by means of a pushing device 96, lowers each group of N2 central bodies 202 to reposition the latter, contemporaneously, with their lower end parts 213 into the lower caps 215, which are located on the lower parts 50*b* of the vertical seats 50 of the sliders 49. Then the upper caps 216 are repositioned onto the central bodies 202 by means of the seventh gripping and positioning device 97.

In particular, the central control unit 11 sends a command to the seventh gripping and positioning device 97 (FIG. 24) so that it first takes with its grippers 98 the upper caps 216 from the vertical pegs 57, where they had been stored temporarily, and arranges them to cover the upper end parts 214 of the central bodies 202, with a lifting movement, translation along the fifth transverse axis Y5 and subsequent lowering.

In a final operational step, also of transfer, the cartomizers 201, finished and/or inspected, as well as provided with their protection caps 215 and 216 again, are first transferred, in a manner analogous to the transfers described previously, from the eighth operational module M8 to the final operational module MF, with advancements at pitch P, and then transferred by the transfer means 28 (FIGS. 25 to 28) from the first transporting member 13 to the third transporting member 301. During this last transfer each cartomizer 201 is moved to a greater distance from the adjacent cartomizer 201, by means of the internal mechanism 101 so that their interaxes increase, passing from the interaxis IC of the vertical seats 50 of the first transporting member 13 to the interaxis IS of the horizontal seats of the third transporting member 301. This occurs during a rotation by 270° of the transfer device 99.

With regard to the modular nature of the machine 10, it should be noted that the shape of each link 31 of the first chain 30 and in particular that of the two arms 33 and 35, makes it possible to remove any intermediate operational module with ease, detaching any of the links 31 from the one next to it, simply by sliding the pivot 36 off the arms 33 and 35, after having removed the small wheels 37, and also to add with ease one or more intermediate operational modules, simply by coupling together the arms 33 and 35 by inserting a corresponding pivot 36 and then adding the small wheels 37.

It will be clear that modifications and/or additional parts and/or steps can be added to the machine 10 and the related method described here, without however going beyond the scope of protection of the present invention.

It will also be clear that even though the present invention is described with reference to a specific example of an embodiment, a person skilled in the art could certainly be able to realize many other equivalent forms of the machine and/or method for the automatic treatment of components of inhalers, in particular cartomizers for electronic cigarettes, having the characteristics as defined in the enclosed claims and therefore falling within the scope of protection as defined by these claims.

In the following claims the purpose of the references in parentheses is to facilitate reading and they should not be considered limiting factors where the scope of protection as defined by the specific claims is concerned.

I claim:

1. A machine for automatic treatment of components of inhalers, the machine comprising:

a first transporting member having:

a first plurality of seats, and a first chain having a plurality of equal links, said first chain defining a first interaxis between two adjacent links;

a first operational module provided with loading means to load said components onto said first transporting member;

a final operational module provided with transfer means to transfer said components outside said first transporting member, the first transporting member being configured to selectively transport said components from the first operational module to the final operational module; and one or more intermediate operational modules interposed between said first operational module and said final operational module and configured to perform work and/or inspection steps on said components;

wherein:

said first operational module, said one or more intermediate operational modules, and said final operational module each have a length which is a respective whole multiple of said first interaxis, wherein each of said operational modules is equipped with mechanical and electric/electronic apparatuses or devices to perform a specific operation on said components, said one or more intermediate operational modules are configured to be selectively added to, or removed from, the machine, a first plural number of seats of said first plurality of seats are associated with each link of the first chain, said seats being aligned on a first longitudinal axis and each seat being configured to accommodate a respective one of the components, and said first interaxis is a whole multiple of an interaxis between two adjacent seats of said first plurality of seats.

2. The machine as in claim 1, wherein said first chain extends between a first toothed wheel arranged in said first operational module and a second toothed wheel arranged in said final operational module, and wherein said first chain, in a zone extending between said first toothed wheel and said second toothed wheel, comprises a plurality of segments each formed by a determinate number of said links and guided by guide means present in said one or more intermediate operational modules.

3. The machine as in claim 2, wherein each of said one or more intermediate operational modules is autonomous with respect to the other operational modules and has a length, measured along a transport direction of said components from said first operational module to said final operational module, equal to that of one of said segments of said first chain.

4. The machine as in claim 1, wherein control means are provided to make said first transporting member perform incremental advancing movements of a determinate pitch, and wherein said pitch is a whole multiple of said first interaxis.

5. The machine as in claim 1, further comprising a controller configured to control said operational modules, wherein when one of said one or more intermediate operational modules is added to, or removed from, the machine, electrical connections of the controller with all the operational modules present allow the controller to manage all the operational modules present independent of their number.

6. A machine for automatic treatment of components of inhalers, the machine comprising a first transporting member having a first plurality of seats and configured to selectively transport said components from a first operational module, provided with loading means to load said components onto said first transporting member, to a final operational module provided with transfer means to transfer said components outside said first transporting member, wherein one or more intermediate operational modules are interposed between said first operational module and said final operational module and configured to perform work and/or inspection steps on said components, wherein said first transporting member comprises a first chain having a plurality of links that are equal to one another, said first chain defining a first interaxis between two adjacent links, wherein said first operational module, said one or more intermediate operational modules, and said final operational module have a length which is a respective whole multiple of said first interaxis, each of said operational modules being equipped with mechanical and electric/electronic apparatuses or devices to perform a specific operation on said components, wherein each component comprises a central body having a lower end part normally protected by a removable lower protective element and an upper end part normally protected by a removable upper protective element, and wherein a first module of said one or more intermediate operational modules comprises a removal unit configured to remove both said lower and upper protective elements from the respective central bodies and to place them on said first transporting member, and a storage unit configured to remove said lower and upper protective elements from the first transporting member to temporarily place them on at least one storage device and then selectively return them to said first transporting member, so that said lower and upper protective elements are associated with different central bodies than the ones from which they were removed.

7. The machine as in claim 6, wherein a second module of said one or more intermediate operational modules comprises a filling unit configured to selectively insert a liquid into the central bodies of said components, and wherein said filling unit comprises a second transporting member parallel to said first transporting member, the second transporting member being configured to selectively transport, with incremental advancing movements of a determinate pitch, a plurality of said central bodies of said components toward injection elements.

8. The machine as in claim 7, wherein said second module is arranged adjacent to said first module and said storage unit is configured so that, when said central bodies of said components have been filled with the liquid and are transferred to said first transporting member, said lower and upper protective elements are already present in said first transporting member to be associated with said central bodies of said components.

9. A machine for automatic treatment of components of inhalers, the machine comprising a first transporting member having a first plurality of seats and configured to selectively transport said components from a first operational module, provided with loading means to load said components onto said first transporting member, to a final operational module provided with transfer means to transfer said components outside said first transporting member, wherein one or more intermediate operational modules are interposed between said first operational module and said final operational module and configured to perform work and/or inspection steps on said components, wherein said first transporting member comprises a first chain having a plurality of links that are equal to one another, said first chain defining a first interaxis between two adjacent links, wherein said first operational module, said one or more intermediate operational modules, and said final operational module have a length which is a respective whole multiple of said first interaxis, each of said operational modules being equipped with mechanical and electric/electronic apparatuses or devices to perform a specific operation on said components, wherein the machine further comprises a further transporting member provided with a second plurality of seats to accommodate said components, and wherein said transfer means comprise a transfer device configured to increase an interaxis between said components while they are transferred from said first transporting member to said further transporting member.

10. The machine as in claim 9, wherein said first plurality of seats lie on a vertical plane and said second plurality of seats lie on a horizontal plane, and wherein said transfer device is configured to perform a rotation of 270° to transfer said components from said vertical plane to said horizontal plane.

* * * * *